US011406231B2

(12) United States Patent
Keily et al.

(10) Patent No.: US 11,406,231 B2
(45) Date of Patent: Aug. 9, 2022

(54) AUTOMATIC ROLL TRANSFER DISPENSER

(71) Applicant: Dispensing Dynamics International, Inc., San Marcos, CA (US)

(72) Inventors: Joel P. Keily, City of Industry, CA (US); Alexander Trampolski, City of Industry, CA (US)

(73) Assignee: Dispensing Dynamics International, Inc., San Marcos, CA (US)

( * ) Notice: Subject to any disclaimer, the term of this patent is extended or adjusted under 35 U.S.C. 154(b) by 140 days.

(21) Appl. No.: 16/857,037

(22) Filed: Apr. 23, 2020

(65) Prior Publication Data

US 2020/0337507 A1 Oct. 29, 2020

Related U.S. Application Data

(60) Provisional application No. 62/839,109, filed on Apr. 26, 2019.

(51) Int. Cl.

| | |
|---|---|
| ***A47K 10/36*** | (2006.01) |
| ***A47K 10/26*** | (2006.01) |
| ***A47K 10/32*** | (2006.01) |

(52) U.S. Cl.

CPC ..... *A47K 10/3687* (2013.01); *A47K 10/26* (2013.01); *A47K 10/3662* (2013.01);

(Continued)

(58) Field of Classification Search

CPC .... A47K 10/34; A47K 10/36; A47K 10/3687; A47K 10/26; A47K 10/3662;

(Continued)

(56) References Cited

U.S. PATENT DOCUMENTS 4,108,513 A * 8/1978 Lander ..... A47K 10/3836 225/34
4,557,426 A * 12/1985 Siciliano ..... A47K 10/3836 225/34

(Continued)

FOREIGN PATENT DOCUMENTS

| | | |
|---|---|---|
| CA | 2359128 | 4/2003 |
| JP | H0611591 U | 2/1994 |
| WO | WO 2009/075950 A1 | 6/2009 |

OTHER PUBLICATIONS

"The International Dispensing System" Catalog, Dispensing Dynamics International, pp. 1-60, 2010.

(Continued)

*Primary Examiner* — William A. Rivera

(74) *Attorney, Agent, or Firm* — Knobbe, Martens, Olson & Bear, LLP

(57) ABSTRACT

Various consumable material dispensing apparatus including automatic roll transfer features are disclosed. In certain embodiments, the apparatus includes a housing, a roll support assembly, a motor, a roll sensor mechanism, and a controller. The housing can include a cabinet, an interior, and an opening. The roll support assembly can support a plurality of rolls. The motor can rotate the roll support assembly from a first position where a first roll is proximate the opening to a second position where a second roll is proximate the opening. The roll sensor mechanism can detect whether a diameter of the first roll is less than a threshold value when the roll support assembly is in the first position. In response, the controller can instruct the motor to rotate the roll support assembly from the first position to the second position.

20 Claims, 22 Drawing Sheets

(52) U.S. Cl.
CPC ..... *A47K 2010/3233* (2013.01); *A47K 2010/3253* (2013.01)

(58) Field of Classification Search
CPC .... A47K 2010/3233; A47K 2010/3253; A47K 2010/3668; A47K 2010/3625; A47K 10/3836; B65H 16/024; B65H 2301/41246; B65H 2408/241; B65H 2408/2412; B65H 2408/2415; Y10T 225/233
See application file for complete search history.

(56) References Cited

U.S. PATENT DOCUMENTS

| | | | | |
|---|---|---|---|---|
| 4,756,485 | A | 7/1988 | Bastian et al. | |
| 4,944,466 | A | 7/1990 | Jespersen | |
| 5,310,129 | A * | 5/1994 | Whittington | A47K 10/3836 242/560.3 |
| 5,636,812 | A * | 6/1997 | Conner | A47K 10/3836 242/559.2 |
| 6,491,251 | B1 * | 12/2002 | Stanland | A47K 10/3687 242/559.2 |
| 6,616,087 | B1 * | 9/2003 | Chern | B65H 35/0026 242/559.2 |
| 7,014,140 | B2 | 3/2006 | Elliott et al. | |
| 7,114,676 | B2 | 10/2006 | Elliott et al. | |
| 10,952,569 | B2 * | 3/2021 | Grosz, Jr. | A47K 10/3836 |
| 2009/0308966 | A1 | 12/2009 | Hjort et al. | |
| 2011/0139920 | A1 * | 6/2011 | Formon | A47K 10/3836 242/559.2 |
| 2018/0325332 | A1 * | 11/2018 | Grosz, Jr. | A47K 10/3836 |
| 2019/0104895 | A1 * | 4/2019 | Johnson | A47K 10/3687 |
| 2020/0253431 | A1 * | 8/2020 | Young | A47K 10/3836 |

OTHER PUBLICATIONS

International Search Report and Written Opinion for International Application No. PCT/US2020/029616, dated Jul. 1, 2020.
International Preliminary Report on Patentability, re PCT Application No. PCT/US2020/029616 dated Nov. 4, 2021.

* cited by examiner

AUTOMATIC ROLL TRANSFER DISPENSER

CROSS REFERENCE

This application claims the priority benefit of U.S. Provisional Patent Application No. 62/839,109, filed Apr. 26, 2019, the entirety of which is incorporated by reference herein.

BACKGROUND

Field

This disclosure generally relates to an apparatus for dispensing consumable material, such as paper tissue from tissue rolls.

Description of Certain Related Art

Tissue dispensers provide a convenient storage system for rolls of consumable material. The rolls of consumable material can be referred to as "tissue rolls," for example, rolls of fibrous paper products or tissue paper (e.g., bathroom tissue, paper towels, or other). Tissue dispensers are generally designed to hold one or multiple rolls of tissue paper and to provide a dispensing mechanism. The dispensing mechanism generally allows a user to retrieve a length of the roll. As one length of tissue paper is retrieved from the dispensing mechanism, an additional length becomes available for retrieval from the roll. This process slowly unrolls the length of the roll of tissue paper.

SUMMARY OF CERTAIN FEATURES

Some tissue dispensers hold multiple tissue rolls, such as in a vertical, rotationally-oriented configuration. Some dispensers include a mechanical knob configured to allow a user to rotate the configuration. When a roll is exhausted, this can enable a user to position a new roll near an opening of the dispenser.

It is sometimes difficult for a user to operate such mechanical knobs and/or to determine when a roll is properly positioned relative to an opening of the dispenser. As a result, the new roll can be damaged (e.g., on ends or corners) and/or partially wasted when the user is attempting to operate the dispenser. Also, health concerns can arise where users are required to touch the mechanical knob, other parts of the dispenser, and/or reach into an interior of the dispenser when attempting to properly position the new roll and/or retrieve a length of the new roll.

It would be beneficial to have a tissue dispenser that automatically provides access to (e.g., via rotation) an additional roll after a first roll is exhausted beyond a certain limit, without requiring any input or action from a user. It would also be beneficial for the tissue dispenser to automatically position the additional roll relative to an opening of the dispenser so as to reduce or minimize interference with portions of the dispenser proximate the opening and/or a user's hand when accessing a length of the additional roll. It would be beneficial for the mechanism to not damage the roll.

At least some of the aforementioned concerns, or other concerns, are overcome by various implementations of the solutions described herein. For example, one aspect of some implementations of a dispenser (also called a "dispensing system") described herein includes structural components that interact to automatically provide accessibility to a new tissue roll when a first tissue roll is exhausted or is near exhaustion. In some implementations, when a first tissue roll is exhausted beyond a certain threshold (e.g., an outside diameter of the roll falls below a threshold), a new tissue roll held within the dispenser is automatically moved (e.g., rotated) closer to an opening of the dispenser to provide accessibility to a user. The dispenser can include a roll support assembly configured to support a plurality of tissue rolls, a motor configured to rotate the roll support assembly, a roll sensor mechanism. The roll sensor mechanism can be configured to detect whether a condition is satisfied, such as whether an outside diameter of a first tissue roll is detected to be below a threshold diameter. The roll sensor mechanism can include a controller in communication with a roll sensor and the motor. In some implementations, the controller can be configured to instruct the motor to rotate the roll support assembly in response to the roll sensor mechanism detecting that the outside diameter of the first tissue roll is below the threshold diameter. For example, in response to the roll sensor mechanism detecting that the outside diameter of the first tissue roll is below the threshold diameter, the controller can instruct the motor to rotate the roll support assembly from a first rotational position, where the first tissue roll is positioned proximate an opening of the dispenser, to a second rotational position, where a second tissue roll is positioned proximate an opening of the dispenser.

In some implementations, a tissue dispenser comprises a housing, a roll support assembly, a motor, and a roll sensor mechanism. The housing can comprise a cabinet, an interior, and an opening. The roll support assembly can be positioned within the interior of the housing and can be configured to support a plurality of rolls of consumable material. The roll support assembly can comprise: a carousel comprising a first plurality of stubs, each of the first plurality of stubs configured to support a first end of a respective one of the plurality of rolls; a base connected to the carousel; and a plurality of wings pivotally connected to the base, the plurality of wings comprising a second plurality of stubs, each of the second plurality of stubs positioned on a respective one of the plurality of wings and configured to support a second end of a respective one of the plurality of rolls. The motor can be configured to rotate the roll support assembly from at least a first rotational position to a second rotational position, wherein, in the first rotational position, a first one of the plurality of rolls is proximate the opening of the housing, and wherein, in the second rotational position, a second one of the plurality of rolls is proximate the opening of the housing. The roll sensor mechanism can be configured to detect whether a diameter of the first one of the plurality of rolls is less than a threshold value when the roll support assembly is in the first rotational position. The tissue dispenser can be configured such that, in response to the roll sensor mechanism detecting that the diameter of the first one of the plurality of rolls is less than the threshold value, the motor rotates the roll support assembly from the first rotational position to the second rotational position.

The roll sensor mechanism can comprise a proximity sensor and a controller. The roll sensor mechanism can comprise a switch and an actuator configured to engage the switch, the actuator moveable between a first position and a second position. The roll sensor mechanism can be configured to detect that the diameter is less than the threshold value when the actuator moves from the first position to the second position. When the diameter is greater than or equal to the threshold value, an end of the first one of the plurality of rolls can present a physical interference that inhibits the actuator from moving from the first position to the second position. When the diameter is less than the threshold value, the physical interference can be removed, thereby allowing the actuator to move from the first position to the second position. The carousel can comprise: a body, wherein the first plurality of stubs extend outward from the body; a projection extending outwards from the body and connected to the base of the roll support assembly; and a plurality of openings in the body, each of the plurality of openings configured to receive at least a portion of the actuator and positioned adjacent to a respective one of the first plurality of stubs. When the actuator of the roll sensor mechanism is in the second position, the actuator can extend through one of the plurality of openings in the body of the carousel. Each of the first plurality of stubs can comprise a notched portion connected to the body of the carousel and an end portion connected to the notched portion, wherein, when the actuator is in the second position, the actuator can be positioned within a space defined by the notch portion and contacts the end portion. When the roll support assembly is in the first rotational position, the actuator can be positioned proximate to a first one of the plurality of openings of the body of the carousel. When the roll support assembly is in the second rotational position, the actuator can be positioned proximate to a second one of the plurality of openings of the body of the carousel.

The tissue dispenser can further comprise a carousel position switch in communication with a controller. The carousel can further comprise a plurality of protrusions connected to the body, a first one of the plurality of protrusions configured to engage the carousel position switch when the roll support assembly is in the first rotational position and a second one of the plurality of protrusions configured to engage the carousel position switch when the roll support assembly is in the second rotational position. Each of the plurality of wings can be configured to pivot relative to the base from a first position and a second position. The second position can provide access to a portion of the interior of the housing, thereby allowing a user to at least partially secure a new roll of consumable product to one of the first plurality of stubs of the carousel.

In some implementations, an apparatus for dispensing consumable material comprises a housing, a roll support assembly, a motor, a roll sensor mechanism, and a controller. The housing can comprise a cabinet, an interior, and an opening. The roll support assembly can be positioned within the interior of the housing and can be configured to support a plurality of rolls of consumable material. The motor can be configured to rotate the roll support assembly from at least a first rotational position to a second rotational position, wherein, in the first rotational position, a first one of the plurality of rolls is proximate the opening of the housing, and wherein, in the second rotational position, a second one of the plurality of rolls is proximate the opening of the housing. The roll sensor mechanism can be configured to detect whether a diameter of the first one of the plurality of rolls is less than a threshold value when the roll support assembly is in the first rotational position. The controller can be in communication with the roll sensor mechanism and the motor. In response to the roll sensor mechanism detecting that the diameter of the first one of the plurality of rolls is less than the threshold value, the controller can be configured to instruct the motor to rotate the roll support assembly from the first rotational position to the second rotational position.

The roll sensor mechanism can comprise a switch and an actuator, wherein the actuator is moveable between a first position and a second position and is configured to engage the switch at least when in the first position. When the diameter is greater than or equal to the threshold value, the first one of the plurality of rolls can present a physical interference that inhibits the actuator from moving from the first position to the second position. When the diameter is less than the threshold value, the physical interference can be removed, thereby allowing the actuator to move from the first position to the second position.

The switch and the actuator can be at least partially secured by the cabinet. The roll support assembly can comprise: a first support frame operatively connected to the cabinet, the first support frame comprising a first plurality of stubs, each of the first plurality of stubs configured to support a first end of a respective one of the plurality of rolls; and a second support frame operatively connected to the first support frame, the second support frame comprising a second plurality of stubs, each of the second plurality of stubs configured to support a second end of a respective one of the plurality of rolls. The second plurality of stubs can be aligned with the first plurality of stubs. The first support frame can comprise a carousel. The carousel can comprise: a body, wherein the first plurality of stubs extend outward from the body; a projection extending outwards from the body; and a plurality of openings in the body, each of the plurality of openings configured to receive at least a portion of the actuator and positioned adjacent to a respective one of the first plurality of stubs. When the actuator of the roll sensor mechanism is in the second position, the actuator can extend through one of the plurality of openings in the body of the carousel. The apparatus can further comprise a gear operatively connected to the motor. The body of the carousel can comprise gear threads configured to mate with teeth of the gear. The motor can be configured to rotate the roll support assembly via engagement of the gear and the gear threads. The second support frame can comprise: a base connected to the projection of the carousel; and a plurality of wings pivotally connected to the base, each of the plurality of wings comprising one of the second plurality of stubs. The apparatus can further comprise a carousel position switch in communication with the controller. The carousel can further comprises a plurality of protrusions connected to the body, a first one of the plurality of protrusions configured to engage the carousel position switch when the roll support assembly is in the first rotational position and a second one of the plurality of protrusions configured to engage the carousel position switch when the roll support assembly is in the second rotational position.

In some implementations, an apparatus for dispensing consumable material comprises: a housing comprising a cabinet, an interior, and an opening; a roll support assembly positioned within the interior of the housing and configured to support a plurality of rolls of consumable material; a motor configured to rotate the roll support assembly with respect to the cabinet to position one of the plurality of rolls proximate the opening of the housing; a roll sensor mechanism configured to detect whether a diameter of the one of the plurality of rolls is less than a threshold value; and a controller in communication with the roll sensor mechanism and the motor. In response to the roll sensor mechanism detecting that the diameter of the one of the plurality of rolls is less than the threshold value, the controller can be configured to instruct the motor to rotate the roll support assembly, thereby positioning a different one of the plurality of rolls proximate the opening in the housing.

For purposes of summarizing the disclosure, certain aspects, advantages, and features of the technology have been described herein. Not necessarily any or all such advantages are achieved in accordance with any particular embodiment of the technology disclosed herein. No aspects of this disclosure are essential or indispensable. Neither the preceding summary nor the following detailed description purports to limit or define the scope of protection. The scope of protection is defined by the claims.

BRIEF DESCRIPTION OF THE DRAWINGS

Certain features of this disclosure are described below with reference to the drawings. The illustrated embodiments are intended to illustrate, but not to limit the embodiments. Various features of the different disclosed embodiments can be combined to form further embodiments, which are part of this disclosure.

DETAILED DESCRIPTION OF CERTAIN EMBODIMENTS

Various features and advantages of the disclosed technology will become more fully apparent from the following description of the several specific embodiments illustrated in the figures. These embodiments are intended to illustrate the principles of this disclosure. However, this disclosure should not be limited to only the illustrated embodiments. The features of the illustrated embodiments can be modified, combined, removed, and/or substituted as will be apparent to those of ordinary skill in the art upon consideration of the principles disclosed herein.

Various consumable material dispensing apparatuses are disclosed. Certain embodiments of the dispensing apparatuses are described in the context of tissue rolls for use in a bathroom setting, due to particular utility in that context. However, the embodiments and inventions disclosed herein can also be applied to other types of rolls of consumable materials, such as paper towels, facial tissues, napkins, cleaning (e.g., sanitizing) wipes, or otherwise. No features, structure, or step disclosed herein is essential or indispensable.

Overview

Figure 1B:
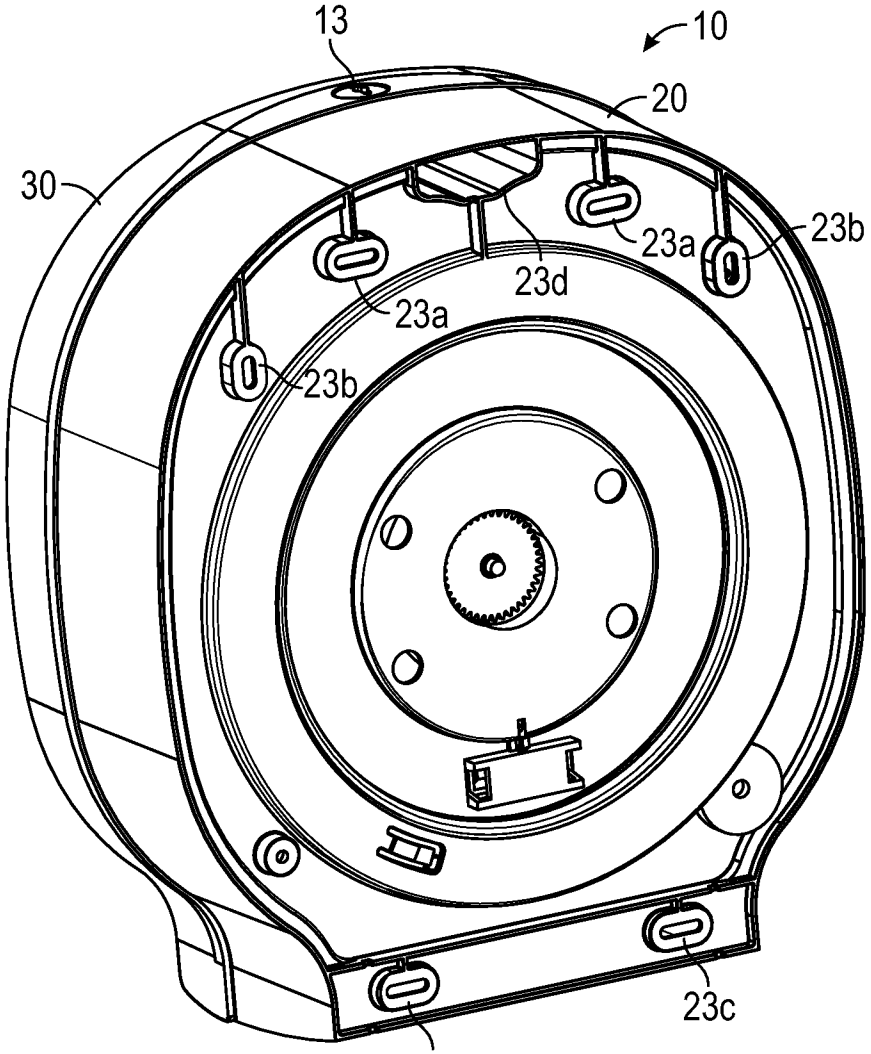
FIGS. 1A-1C illustrate various perspective views of a dispenser.
Figure 1A:
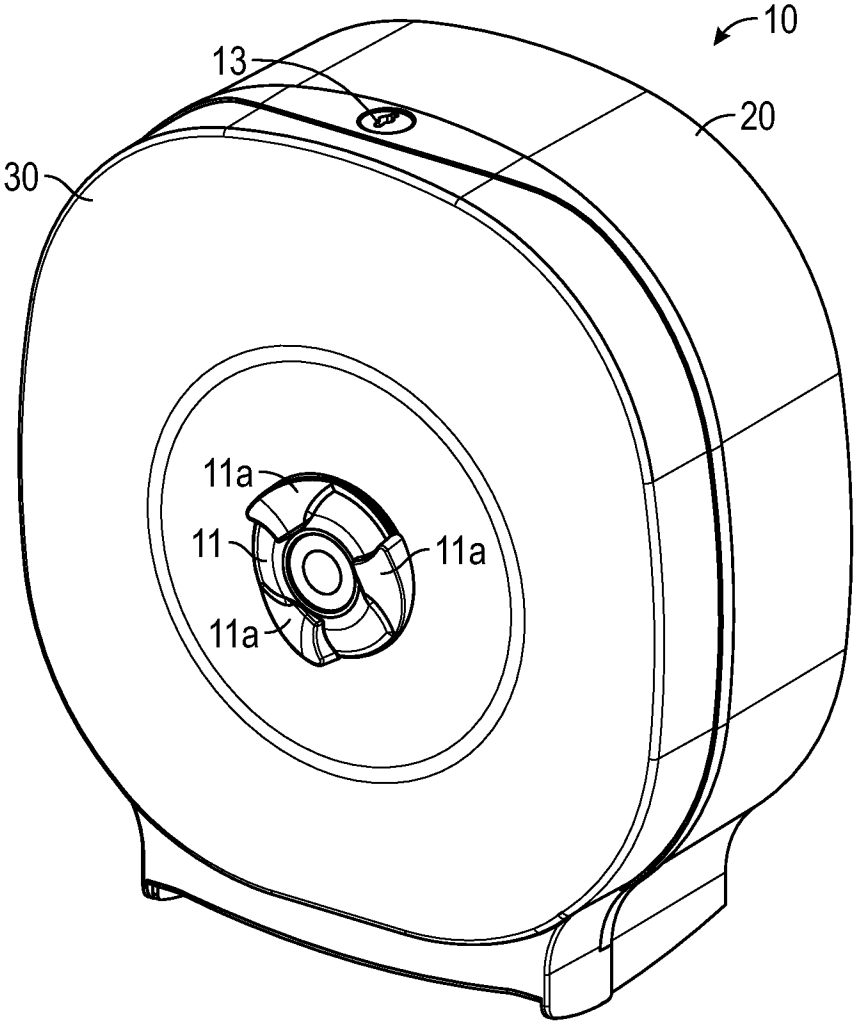
Figure 1C:
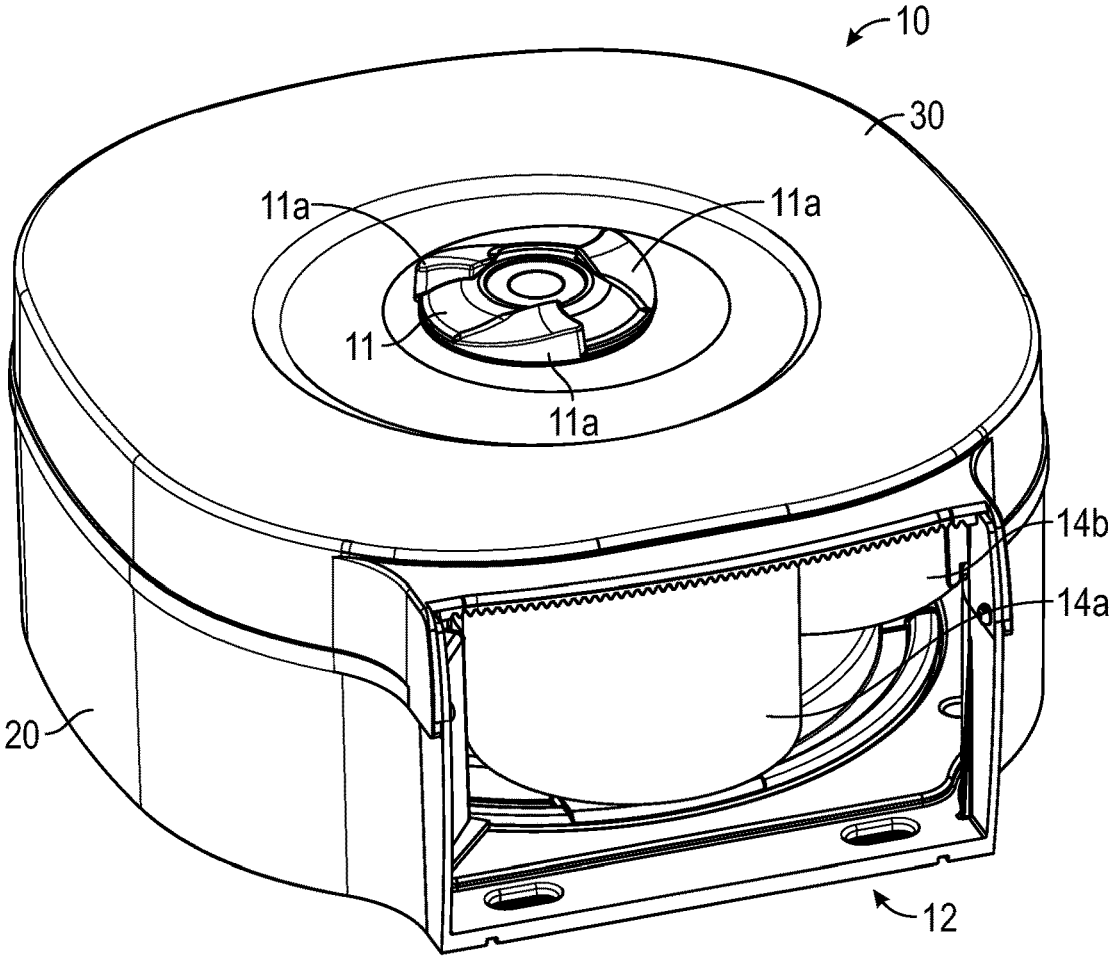
Figure 1D:
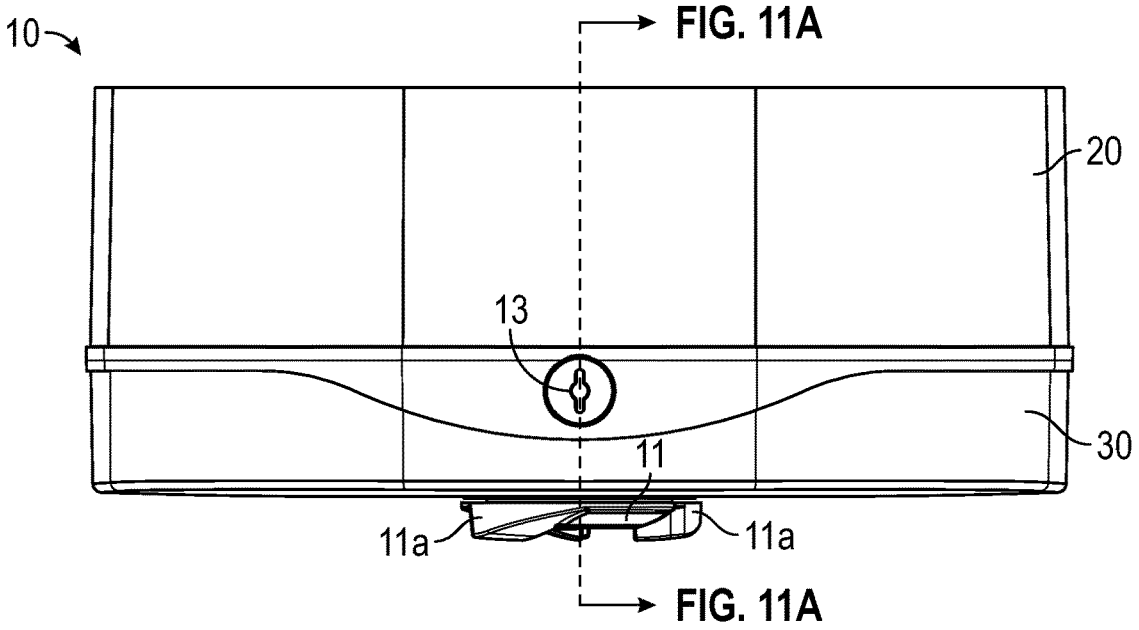
FIG. 1D illustrates a top view of the dispenser of FIGS. 1A-1C.

FIGS. 1A-1D illustrate various views of a dispenser 10. FIGS. 1A and 1B illustrate front and back perspective views (respectively) of the dispenser 10. FIGS. 1C and 1D illustrate bottom perspective and top views (respectively) of the dispenser 10. As discussed herein, the dispenser 10 can allow for dispensing of a roll of consumable material (also called a "tissue roll"), such as paper towels, toilet tissue, facial tissue, cleaning wipes, etc. In some variants, the dispenser 10 provides access to consumable material that is wound on a core and positioned within an interior of the dispenser 10. The dispenser 10 can be a toilet paper dispenser, paper towel dispenser, facial tissue dispenser, napkin dispenser, wipes dispenser, or other type of dispenser capable of dispensing and/or providing access to consumable material.

The dispenser 10 can include a support portion, such as a cabinet 20 (FIGS. 1A-1D). The dispenser 10 can include a cover 30 that is connected with the cabinet 20. As shown in FIG. 1C, the dispenser 10 can include an opening 12. The opening 12 can be bounded by, or part of, the cabinet 20 and/or the cover 30. As shown in at least FIGS. 1C and 3A-3B, one or more rolls of consumable material, such as tissue rolls 14*a*, 14*b*, 14*c*, 14*d*, can be held within an interior of the dispenser 10, as described further below. As shown in FIG. 1B, the cabinet 20 can include one or more openings 23*a*, 23*b*, 23*c*, 23*d* that can be configured to facilitate mounting of the dispenser 10 to a wall. For example, one or more of the openings 23*a*, 23*b*, 23*c*, 23*d* can be sized and/or shaped to receive fasteners in order to assist in mounting the dispenser 10 to a wall.

The dispenser 10 can include a latch that allows the cover 30 to removably secure to the cabinet 20. For example, with reference to at least FIGS. 3A-3B, the cover 30 can include a latch 15 that can connect to a latching portion 17 of the cabinet 20. Further, with reference to FIGS. 1A, 1B, and 1D, the cover 30 can include one or more key slots 13 sized to receive portions of a key that can interact with the latch 15 and/or latching portion 17 to disengage the cover 30 from the cabinet 20. In some embodiments, the latch 15 is connected to a portion of the cover 30, for example, to a latch housing 16 of the cover 30 (see FIG. 3B).

Figure 3A:
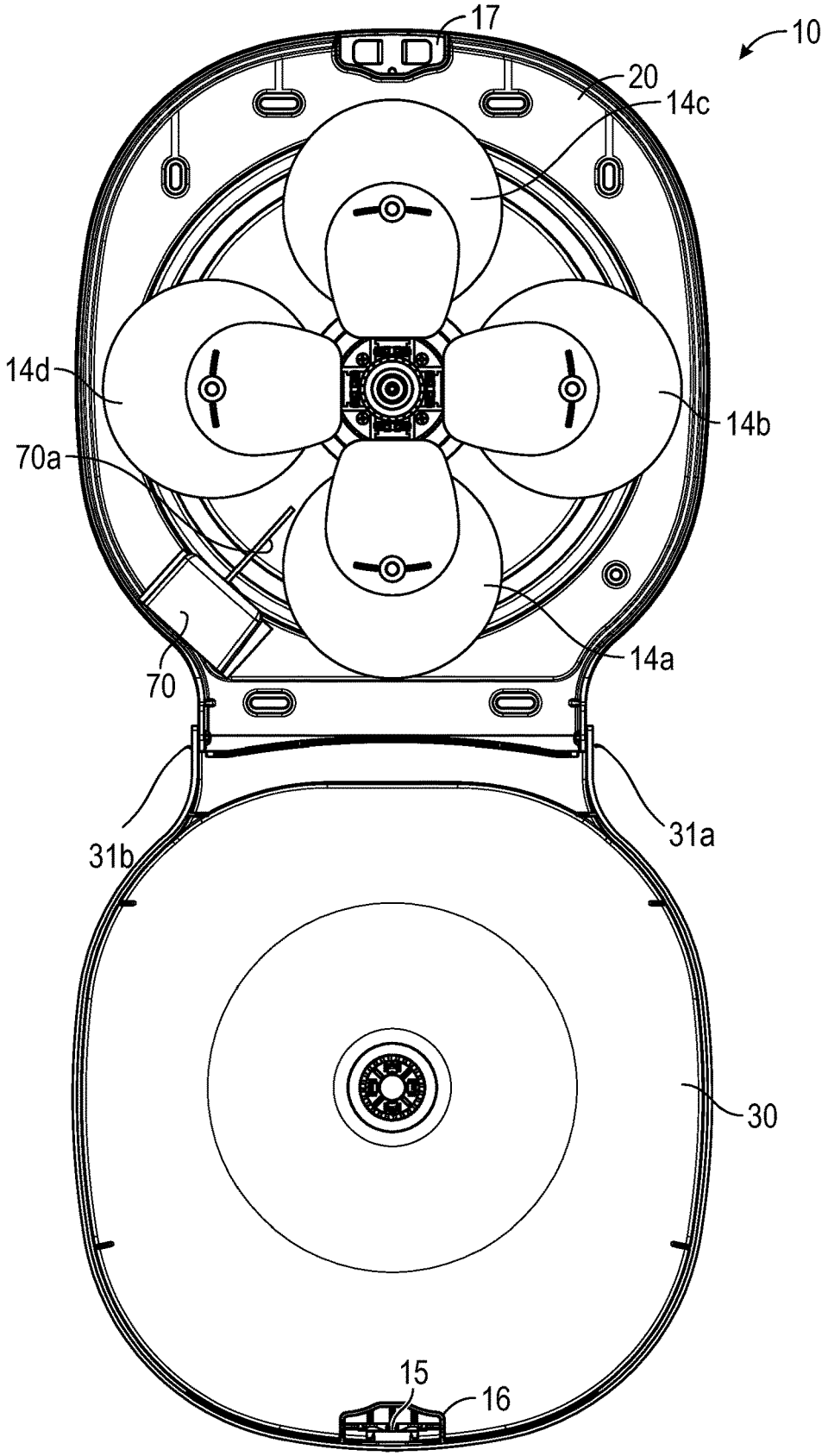
FIGS. 3A-3B illustrate views of the dispenser of FIGS. 1A-1C with a cover of the dispenser in an open position.
Figure 3B:
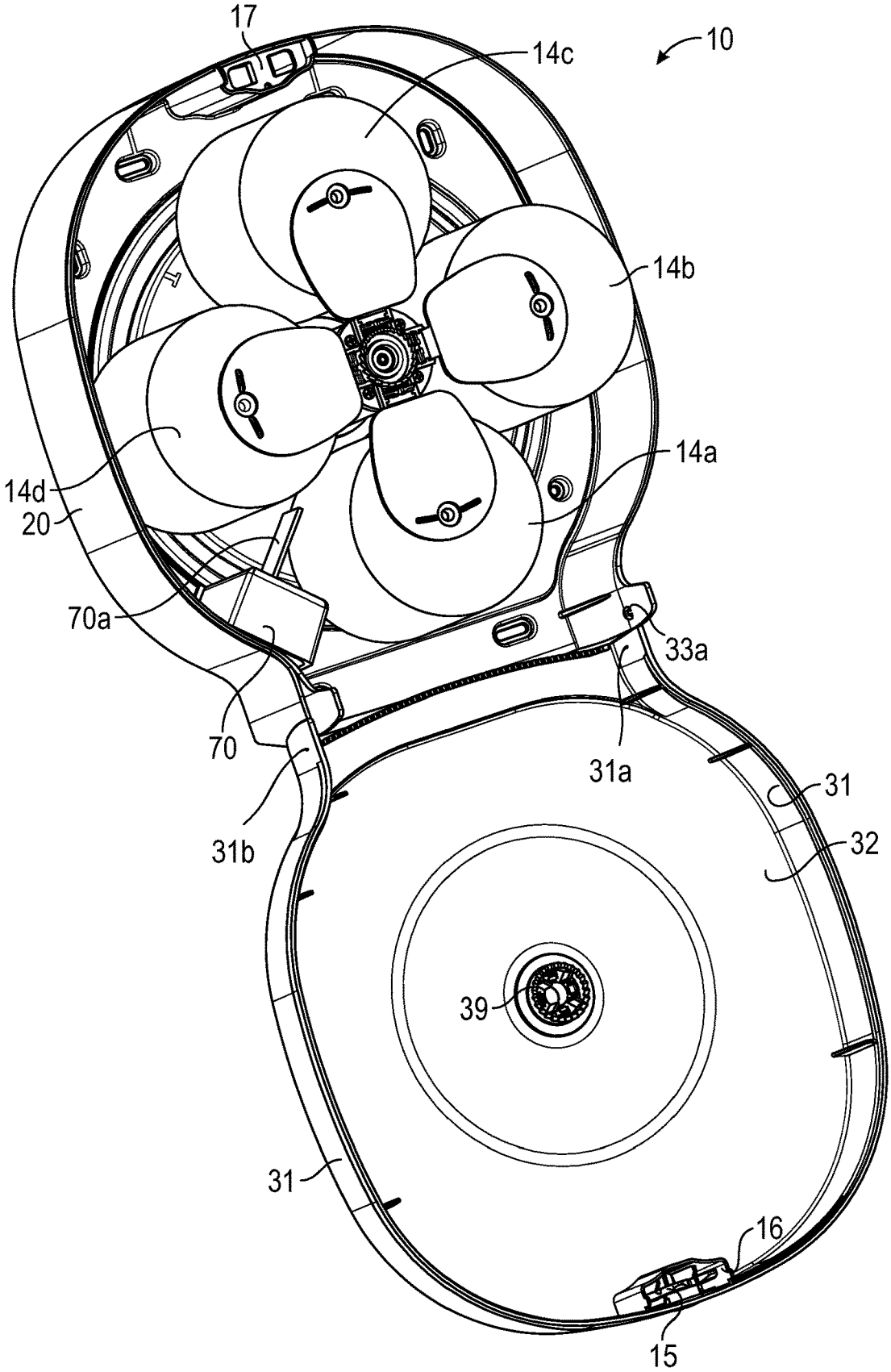

The cover 30 can be movably connected to the cabinet 20. For example, a portion of the cover 30 can be rotatably connected to a portion of the cabinet 20. With reference to FIGS. 3A-3B, the cover 30 can be rotatably connected to the cabinet 20 such that, when the latching portion 17 is disengaged from the latch 15, the cover 30 can rotate with respect to the cabinet 20. Such configuration can allow the cover 30 to be rotatably opened to allow access into the interior of the dispenser 10. Such access can allow a user to insert one or more tissue rolls into the dispenser 10, for example, via insertion of one of the tissue rolls 14*a*, 14*b*, 14*c*, 14*d* between the stubs 44, 56 as discussed further below.

Figure 4:
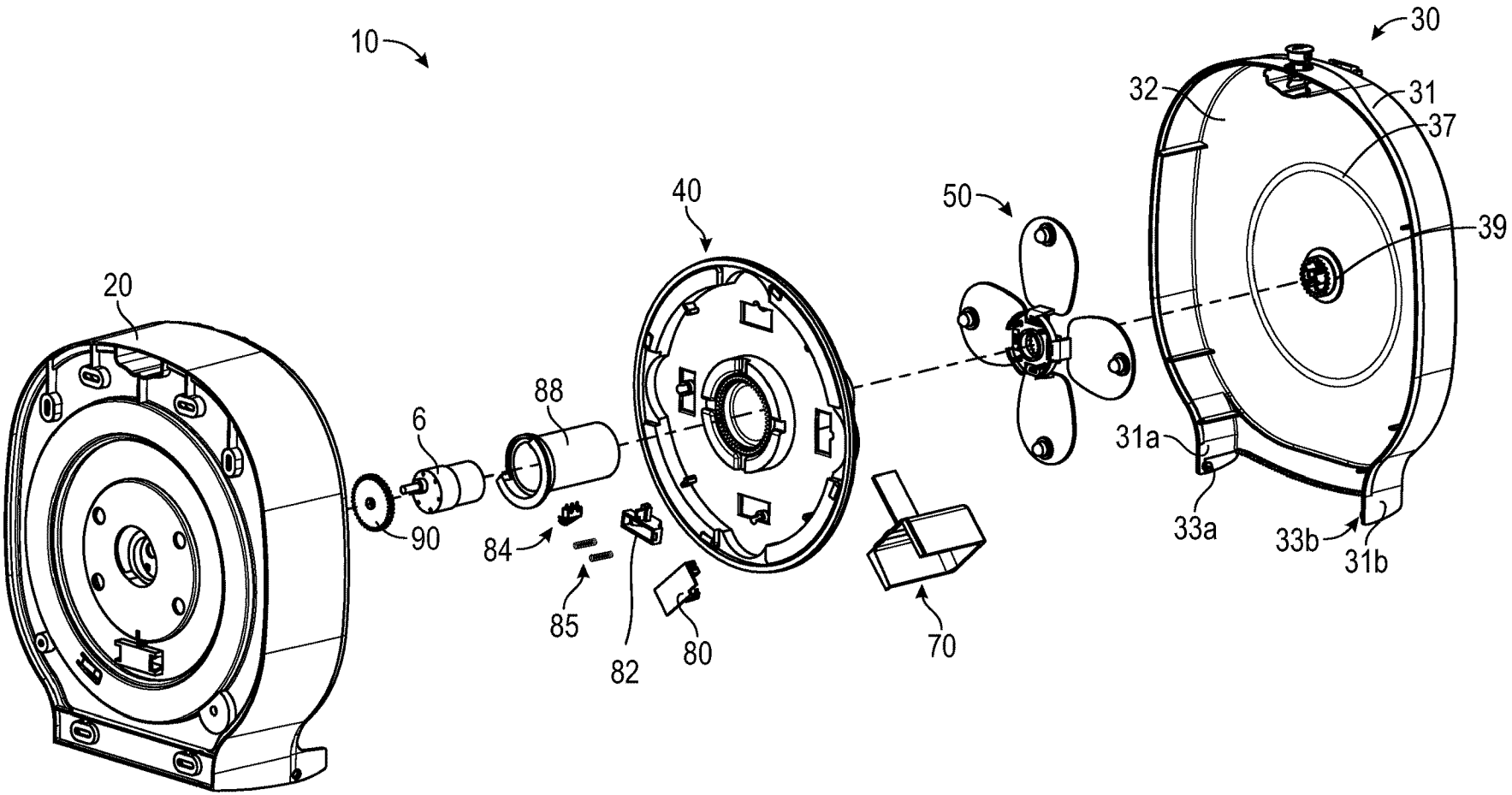
FIG. 4 illustrates an exploded perspective view of the dispenser of FIGS. 1A-1C.
Figure 5B:
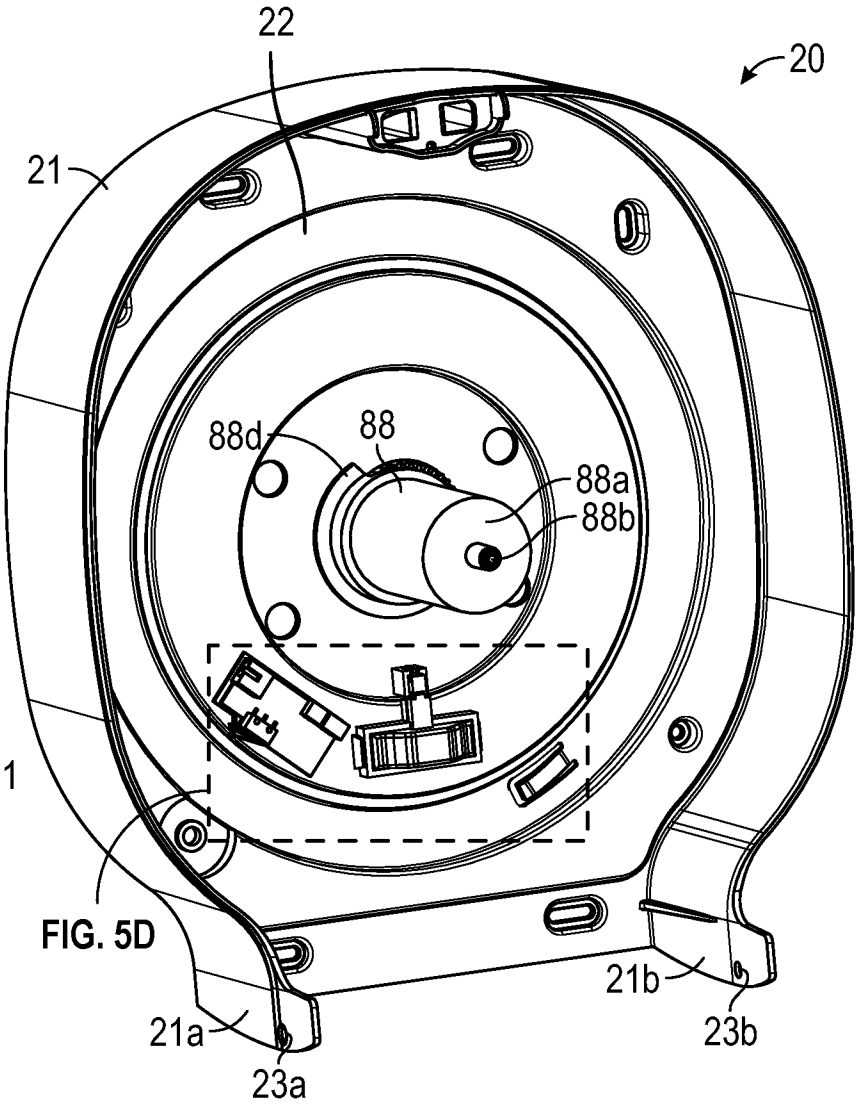
FIG. 5B illustrates the cabinet of FIG. 5A with additional components thereto in accordance with aspects of this disclosure.
Figure 5A:
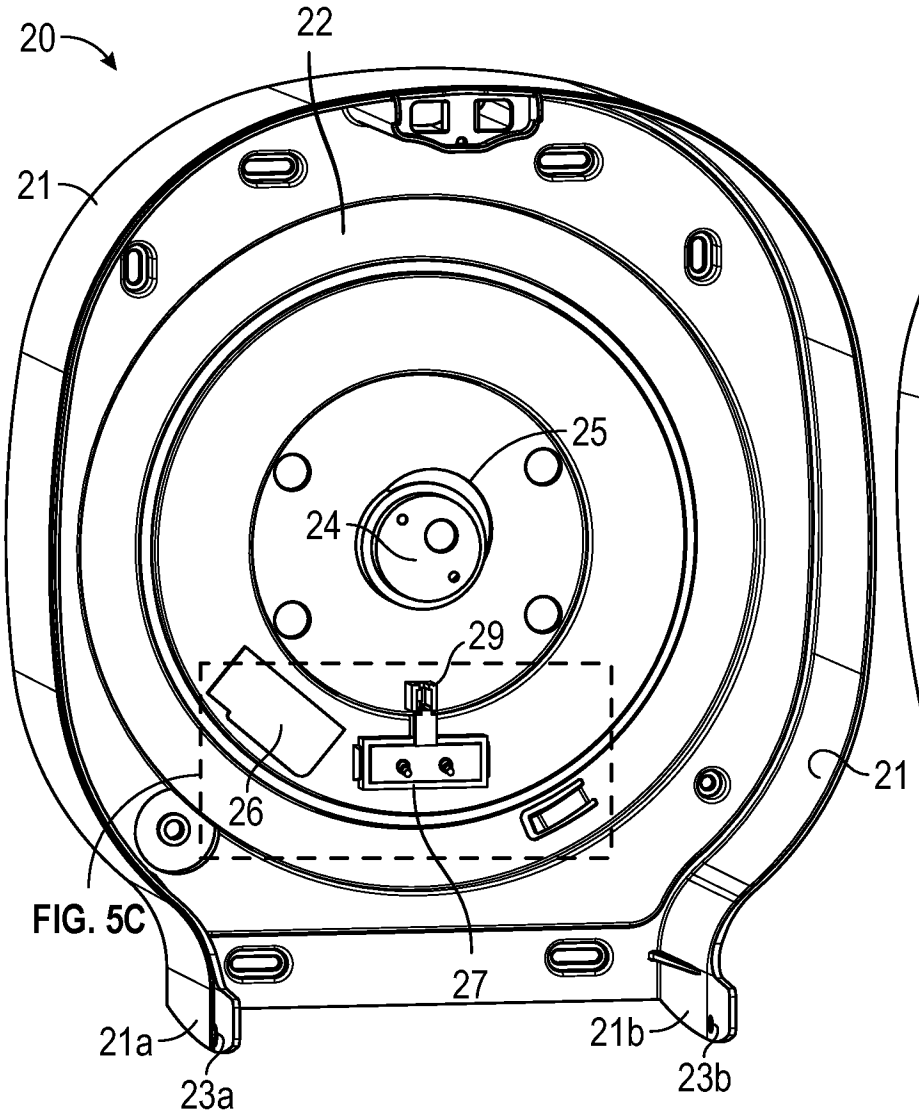
FIG. 5A illustrates a perspective view of a cabinet of the dispenser of FIGS. 1A-1C.

With continued reference to FIGS. 3A-3B and FIG. 4, the cover 30 can include a base wall 32 and a sidewall 31 extending along a portion of a perimeter of the base wall 32 from a first end 31*a* to a second end 31*b*. With reference to FIGS. 5A-5B, the cabinet 20 can include a base wall 22 and a sidewall 21 extending along a portion of a perimeter of the base wall 22 from a first end 21*a* to a second end 21*b*.

The cover 30 can include one or more protrusions configured to secure to portions of the cabinet 20. For example, the cover 30 can include protrusions 33*a*, 33*b* (FIG. 4) sized and/or shaped to be received in openings 23*a*, 23*b* on the first and second ends 21*a*, 21*b* of the sidewall 21 of the cabinet 20 (FIGS. 5A-5B). The protrusions 33*a*, 33*b* can be flexible and/or resilient so as to enable the protrusions 33*a*, 33*b* to compress when passing through the openings 23*a*, 23*b* and expand once a tip of the protrusions 33*a*, 33*b* passes completely through the openings 23*a*, 23*b*. In some variants, the protrusions 33*a*, 33*b* can snap into securement after the tip of the protrusions 33*a*, 33*b* passes through the openings 23*a*, 23*b*. The protrusions 33*a*, 33*b* can be configured to inhibit or prevent movement of the cover 30 with respect to a direction parallel to an axis extending through the openings 23*a*, 23*b* but allow rotation of the cover 30 about such axis. Such configuration can allow the cover 30 to rotate, while connected to the cabinet 20, between an open position (e.g., FIGS. 3A-3B) and a closed position (e.g., FIGS. 1A-1D). In some variants, the openings 23*a*, 23*b* are circular and the protrusions 33*a*, 33*b* have a cross-section that is at least partially circular.

With reference to FIGS. 1A, 1C, and 1D, the dispenser 10 can include a knob 11. The knob 11 can allow a user to rotate a portion of the dispenser 10 to position a tissue roll held by the dispenser 10 proximate the opening 12 of the dispenser 10. The knob 11 can be coupled with an engagement portion 39 that protrudes away from the base wall 32 of the cover 30 and/or that includes teeth configured to mate with teeth 52*h* of a base 52 of the support frame 50 to allow rotation of the support frame 50 in response to rotation of the knob 11 (see FIGS. 3B, 7A, 8B, and 11A). Further, as discussed below, the base 52 can engage a projection 42 of the carousel 40 in order to allow the carousel 40 to rotate when the base 52 rotates (see FIGS. 6B, 7A, 8A, and 11A). Accordingly, the knob 11 can allow a user to rotate the support frame 50 and carousel 40 to position a different one of the tissue rolls 14*a*, 14*b*, 14*c*, 14*d* proximate the opening 12 of the dispenser 10. The knob 11 can include one or more grip protrusions 11*a* configured to help a user grip or otherwise engage the knob 11 to rotate the knob 11.

Figure 2:
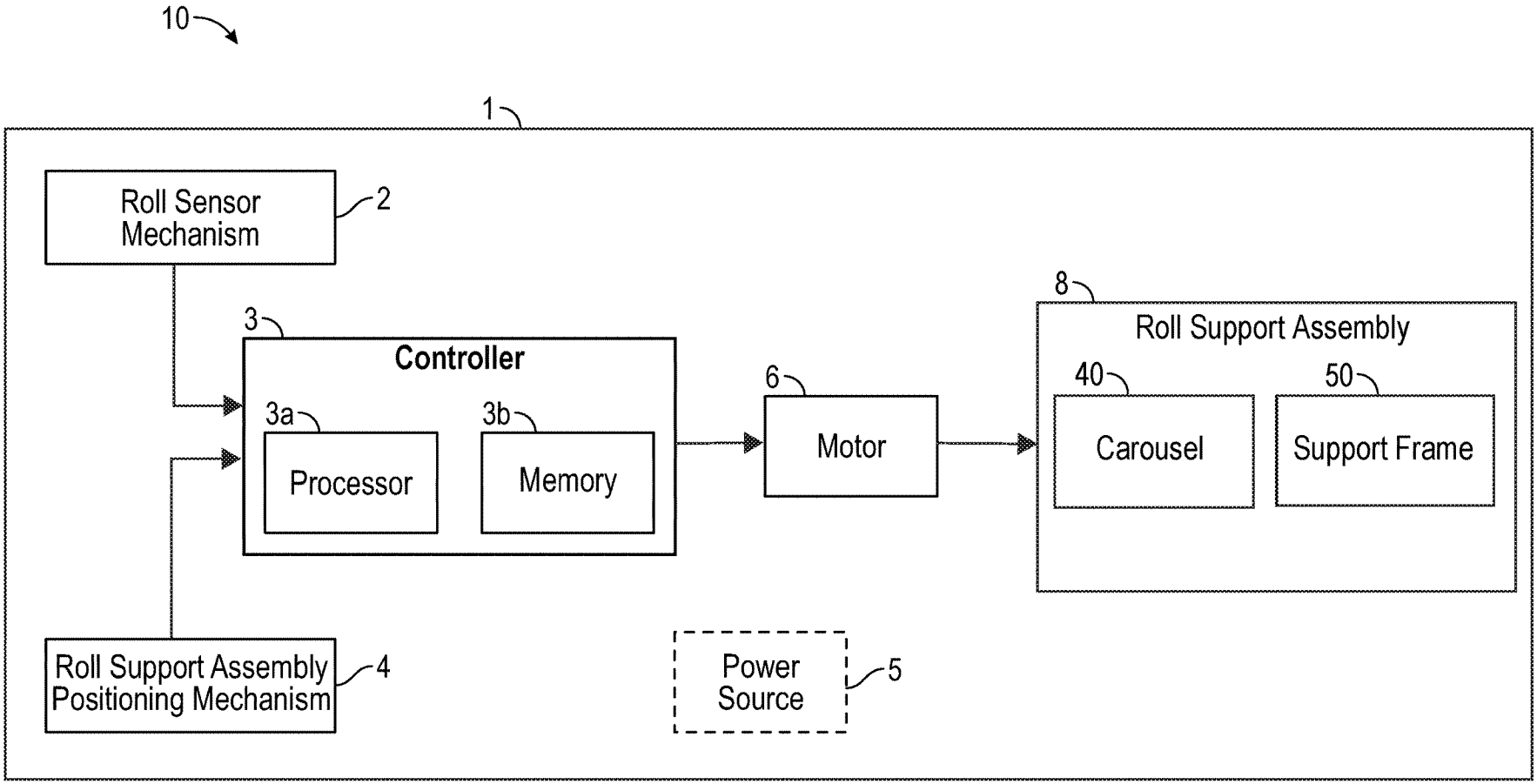
FIG. 2 illustrates a schematic diagram of the dispenser of FIGS. 1A-1C.

FIG. 2 illustrates a schematic diagram of a portion of the dispenser 10. As shown, the dispenser 10 can include a housing 1, which can comprise the cabinet 20 and/or cover 30. The dispenser 10 can include a motor 6, which can be configured to cause rotation of a portion of the dispenser 10 and re-positioning of one or more of the tissue rolls 14*a*, 14*b*, 14*c*, 14*d* within an interior of the dispenser 10. For example, the motor 6 can cause rotation of a roll support assembly 8 of the dispenser 10. In some variants, the motor 6 is powered by a power source, such as a source of AC or DC electrical power. In some variants, the motor 6 is powered by an on-board power source 5, such as a battery, capacitor, or otherwise, that is positioned within, or adjacent to, the housing 1 of the dispenser 10. In some variants, the motor 6 is configured to receive power from an external source, such as from a console, wall socket, or other external power source. For example, in some variants, the housing 1 includes an electrical connector configured to connect with an end of a power cable that is connected to a wall socket.

As shown in FIG. 2, the dispenser 10 can include the controller 3. The controller 3 can be in communication with the motor 6 and/or configured to instruct the motor 6 to operate. As also shown, the controller 3 can include a processor 3*a* and a memory 3*b* coupled with the processor 3*a*. In some variants, the controller 3 is embodied in a printed circuit board, such as the printed circuit board 80 as shown in at least FIG. 4.

As discussed elsewhere herein, the dispenser 10 can support one or more tissue rolls in a rotational configuration and can be configured to rotate the one or more tissue rolls in order to position one of the rolls proximate the opening 12, thereby providing access to a user. For example, with reference to FIG. 4, the dispenser 10 can include a roll support assembly 8 configured to support a plurality of tissue rolls 14*a*, 14*b*, 14*c*, 14*d* and a motor 6 configured to rotate the roll support assembly 8 when a radius or a diameter (e.g., outside diameter) of one of the tissue rolls 14*a*, 14*b*, 14*c*, 14*d* (such as tissue roll 14*a*) is below a threshold value. As discussed below, the roll support assembly 8 can comprise the carousel 40 and/or the support frame 50. The embodiment illustrated is configured to hold 4 tissue rolls, but variants that hold more or fewer of rolls are contemplated, such as 1, 2, 3, 5, 6, 7, 8, or more rolls.

With continued reference to FIG. 2, the dispenser 10 can include the roll sensor mechanism 2. The roll sensor mechanism 2 can be configured to detect whether a diameter of a first tissue roll (such as tissue roll 14*a* as shown in FIGS. 1C and 3A-3B) is less than a threshold value. The roll sensor mechanism 2 can be in communication with, and/or can include, the controller 3. Certain embodiments are configured such that, when (e.g., in response to) the roll sensor mechanism 2 detects that the diameter is less than the threshold value, the controller 3 instructs the motor 6 to rotate the roll support assembly 8 so that a second tissue roll (such as tissue roll 14*b* as shown in FIGS. 1C and 3A-3B) is positioned proximate the opening 12. The roll sensor mechanism 2 can include mechanical and/or electronic components that can allow the roll sensor mechanism 2 to operate in such manner. In some variants, the roll sensor mechanism 3 comprises a proximity sensor configured to detect whether a diameter of one of the tissue rolls is less than a threshold value without physically contacting the tissue rolls. For example, the proximity sensor can be an optical sensor, ultrasonic sensor, infrared sensor among others. In some implementations, the roll sensor mechanism 2 can comprise the switch 84 and the actuator 82 as discussed further below. In some embodiments, the roll sensor mechanism 2 comprises the controller 3. In certain implementations, a roll control unit comprises the roll sensor mechanism 2 and the controller 3.

In some variants, the dispenser 10 includes a roll support assembly positioning mechanism 4. The roll support assembly positioning mechanism 4 can be configured to determine a position (e.g., rotational position) of the roll support assembly 8 within the interior of the dispenser 10. This can enable the dispenser 10 to detect whether one of the tissue rolls is properly aligned with respect to the opening 12. The roll support positioning mechanism 4 can be in communication with the controller 3 and can allow the controller 3 to determine when to instruct the motor 6 to stop (e.g., stop rotation of the roll support assembly 8).

In some variants, the roll support positioning mechanism 4 comprises a sensor, such as a proximity sensor. The sensor can be configured to detect a position of a portion of one of the tissue rolls within the interior of the dispenser 10. For example, the roll support positioning mechanism 4 can include an optical sensor configured to detect when the side of one of the tissue rolls is proximate (e.g., above) a middle of the opening 12.

In some variants, the roll support positioning mechanism 4 comprises a switch 80*a*. The switch 80*a* can be on a printed circuit board 80 of the dispenser 10. As discussed further below, the switch 80*a* can interact with (e.g., contact) with one or more indicator protrusions 49 on the carousel 40 when the carousel 40 is rotated with respect to the printed circuit board 80 which can be held stationary via a portion of the cabinet 20. As discussed in more detail below, such indicator protrusions 49 can be positioned with respect to the openings 45 of the carousel (which can in turn be positioned near the stubs 44 and ends of the tissue rolls 14*a*-14*d*). The indicator protrusions 49 can assist in defining rotational positions of the roll support assembly 8 that correspond with the location of the tissue rolls supported therein. Interaction between the one or more indicator protrusions 49 and the printed circuit board 80 and/or switch 80*a* can be detected by and/or communicated to the controller 3, which can enable the controller 3 to instruct the motor 6 to, for example, rotate or stop rotating the tissue rolls in response.

In some variants, the controller 3 can be configured to automatically instruct the motor 6 to rotate until the controller 3 determines that the roll support assembly 8 is in a nominal dispensing position (e.g., a position where at least one of the plurality of tissue rolls 14*a*, 14*b*, 14*c*, 14*d* is properly aligned with the opening 12). For example, the controller 3 can be configured to automatically instruct the motor 6 to rotate until the controller 3 determines that the switch 80*a* is engaged (e.g., depressed) by an one of the indicator protrusions 49, at which point the controller 3 can instruct the motor 6 to stop rotation. This can advantageously inhibit or prevent the roll support assembly 8 from being in position where one or more of the tissue rolls 14*a*, 14*b*, 14*c*, 14*d* is improperly positioned with respect to the opening 12, such as one of the rolls 14*a*, 14*b*, 14*c*, 14*d* being in misaligned with the opening (which could hinder access to the roll) and/or in contact with a portion of the dispenser 10 (and thus could be damaged). For example, if a user rotates knob 11 and thus the roll support assembly 8 such that one of the rolls 14*a*, 14*b*, 14*c*, 14*d* contacts the flange 70*a* (discussed further below), "drag" on one of the roll 14*a*, 14*b*, 14*c*, 14*d* may cause a retrieved length of one of the rolls to tear prematurely, thereby creating a negative user experience. In such cases, it may be the case that the switch 80*a* is not contacting one of the indicator protrusions 49. As discussed above, such condition may trigger the controller 3 to instruct the motor 6 to rotate the roll support assembly 8 to return the roll support assembly 8 to a correct or proper dispensing position.

FIG. 4 illustrates an exploded view of the dispenser 10. As discussed above, the dispenser 10 can include the cabinet 20 and the cover 30. The dispenser 10 can include a roll support assembly 8 configured to support one or more tissue rolls within an interior of the dispenser. The roll support assembly 8 can include a first support frame or component that supports a first end of each of the one or more tissue rolls and a second support frame or component that supports a second end of each of the one or more tissue rolls. The first support frame can be, for example, a carousel, such as carousel 40. The second support frame can be the support frame 50 shown in FIG. 4, which is described in more detail below. With reference to FIG. 4, the dispenser 10 can include a printed circuit board 80, an actuator 82, one or more springs 85, a switch 84, a coupler 88, a motor 6, a gear 90, and/or a housing 70. Various components of the dispenser 10 (e.g., the cabinet, first support frame, and/or second support frame) can be formed of a rigid material, such as hard plastic, metal, or any suitable material (e.g., ABS polyethylene, polypropylene, and/or other polymers).

Cabinet

FIG. 5A illustrates a perspective view of the cabinet 20. As discussed above, the cabinet 20 can include a base wall 22 and a sidewall 21 extending along a portion of a perimeter of the base wall 22 from a first end 21*a* to a second end 21*b*. The cabinet 20 can include an engagement portion configured to couple to a portion of the carousel 40. For example, the cabinet 20 can include the engagement portion 24 extending outward (e.g., generally perpendicular) from the base wall 22. In some variants, the engagement portion 24 is positioned at or near a center of the base wall 22 (FIG. 5A). In some variants, the base wall 22 includes an opening 25 adjacent (e.g., behind) the engagement portion 24. The engagement portion 24 can be cylindrical or partially cylindrical. The engagement portion 24 can be connected to the base wall 22 along a portion of a perimeter of the engagement portion 24.

The engagement portion 24 can be configured to secure to a coupler 88, such as a post, that can secure to a portion of the carousel 40. For example, with reference to FIGS. 5A-5B, 6A-6B, and 11A, the coupler 88 can secure the cabinet 20 to the carousel 40 by connecting to the engagement portion 24 to the projection 42. For example, a first end 88*d* of the coupler 88 can secured to and/or around the engagement portion 24 and a second end 88*a* of the coupler 88 can secure to and/or within a portion of the end 42*a* of the projection 42. In some variants, the end 88*a* of the coupler 88 includes a stem 88*b* extending outward from the end 88*a* of the coupler 88. The stem 88*b* can be configured to secure to and/or within an inner cavity 42*d* of the end 42*a* of the projection 42. In some variants, the coupler 88 can connect the cabinet 20 and the carousel 40 and, when the dispenser 10 is assembled as shown in FIG. 4, the coupler 88 can house the motor 6 or a portion thereof.

The cabinet 20 can include one or more recesses or cavities configured to receive and/or support the switch 84 and/or the actuator 82. For example, with reference to FIGS. 5A-5D, the cabinet 20 can include a cavity 27 configured to receive and/or support at least a portion of the actuator 82, and/or a cavity 29 configured to receive and/or support at least a portion of the switch 84. As shown, the cavities 27, 29 can be positioned near each other such that the actuator 82 is configured to engage (e.g., contact) the switch 84, as explained in more detail below. As also shown, the cavity 27 can include a recess 27*b* (e.g., a channel and/or opening) which can connect to the cavity 29. The recess 27*b* can be sized and/or shaped to receive a tail 82*b* of the actuator 82 (FIGS. 10A-10D), which is described in more detail below.

In some variants, the cabinet 20 includes one or more prongs 27*a* positioned within the cavity 27. The one or more prongs 27*a* can couple with and/or support the one or more springs 85. As discussed in more detail below, the one or more springs 85 can act to bias the actuator 82 towards a second position (e.g., an extended position).

As discussed above, the dispenser 10 can include a printed circuit board 80. The printed circuit board 80 can be secured to a portion of the cabinet 20, for example, a portion of the base wall 22 of the cabinet 20. In some variants, the portion comprises a raised surface 26 sized and/or shaped to correspond with a size and/or shape of the printed circuit board 80. Such configuration can indicate proper placement of the printed circuit board 80 within the dispenser 10 during assembly. The raised surface 26 can include an adhesive configured to secure the printed circuit board 80 in place.

As shown in FIGS. 5A-5D, the cabinet 20 can include one or more direction control features, such as tabs 28 extending from a surface of the base wall 22. The tabs 28 can be located in an opening 28*a* in the base wall 22. The tab 28 can be flexible and can move relative to the opening 28*a*. For example, the tab 28 can be pushed at least partially through the opening 28*a* by one or more tabs 43 on the carousel 40 (FIG. 6A) when the carousel 40 is rotated clockwise or alternatively, counterclockwise. Additionally, as discussed below, the tab 28 can act to inhibit (e.g., prevent) rotation of the carousel 40 relative to the cabinet 20 in either a clockwise or counterclockwise direction. For example, a free (e.g., cantilevered) end of the tab 28 can obstruct (e.g., via contact) one or more of the tabs 43 of the carousel 40 when the carousel 40 is rotated relative to the cabinet 20. In certain implementations, the tabs 28 act as a ratchet and/or permit only one rotational direction of movement of the carousel 40.

Roll Support Assembly

As discussed above, the dispenser 10 can include the roll support assembly 8. The roll support assembly 8 can be configured to support one or more tissue rolls within an interior of the dispenser 10 (such as tissue rolls 14*a*, 14*b*, 14*c*, 14*d*). As also discussed above, the roll support assembly 8 can include a first support frame (also called a "carousel") configured to support a first end of each of the one or more tissue rolls. The first support frame can be the carousel 40 illustrated in the exploded view of the dispenser 10 shown in FIG. 4. The roll support assembly 8 can include a second support frame (also called an "outer shell") configured to support a second end of each of the one or more tissue rolls. The second support frame can be the second support frame 50 shown in FIG. 4, which is further discussed below. As discussed elsewhere herein, the roll support assembly 8 of the dispenser 10 can be rotated by the motor 6 to position a second (e.g., new) one of the supported tissue rolls proximate the opening 12 of the dispenser 10 in order to provide access to a user, for example, after a first one of the tissue rolls is exhausted (e.g., a diameter is equal or less than a threshold value). In some variants, the roll support assembly 8 is configured to support a plurality tissue rolls on one side. For example, in some variants, the roll support assembly 8 can include only one of the carousel 40 or the support frame 50, each of which are discussed further below. In such variants, the stubs 44 of the carousel 40 (discussed further below) or the stubs 56 of the support frame 50 (discussed further below) can be configured to support each of the plurality of tissue rolls (e.g. tissue rolls 14*a*, 14*b*, 14*c*, 14*d*).

Carousel

Figure 6B:
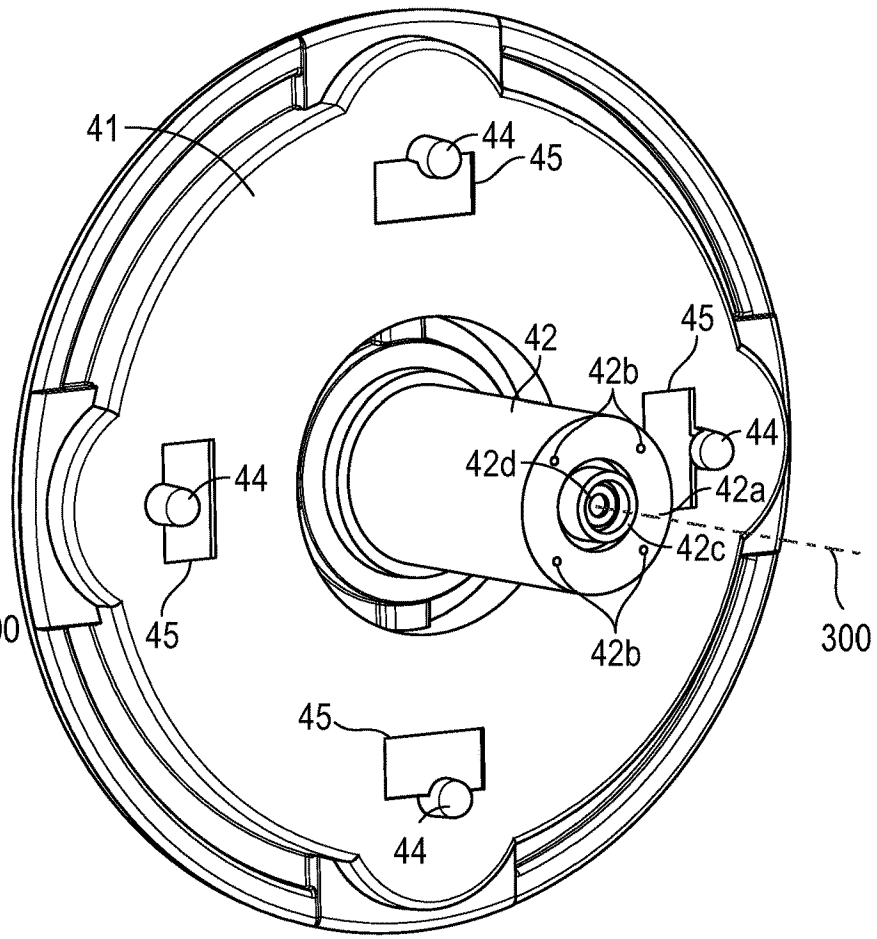
FIGS. 6A-6B illustrate perspective views of a carousel of the dispenser of FIGS. 1A-1C.
Figure 6A:
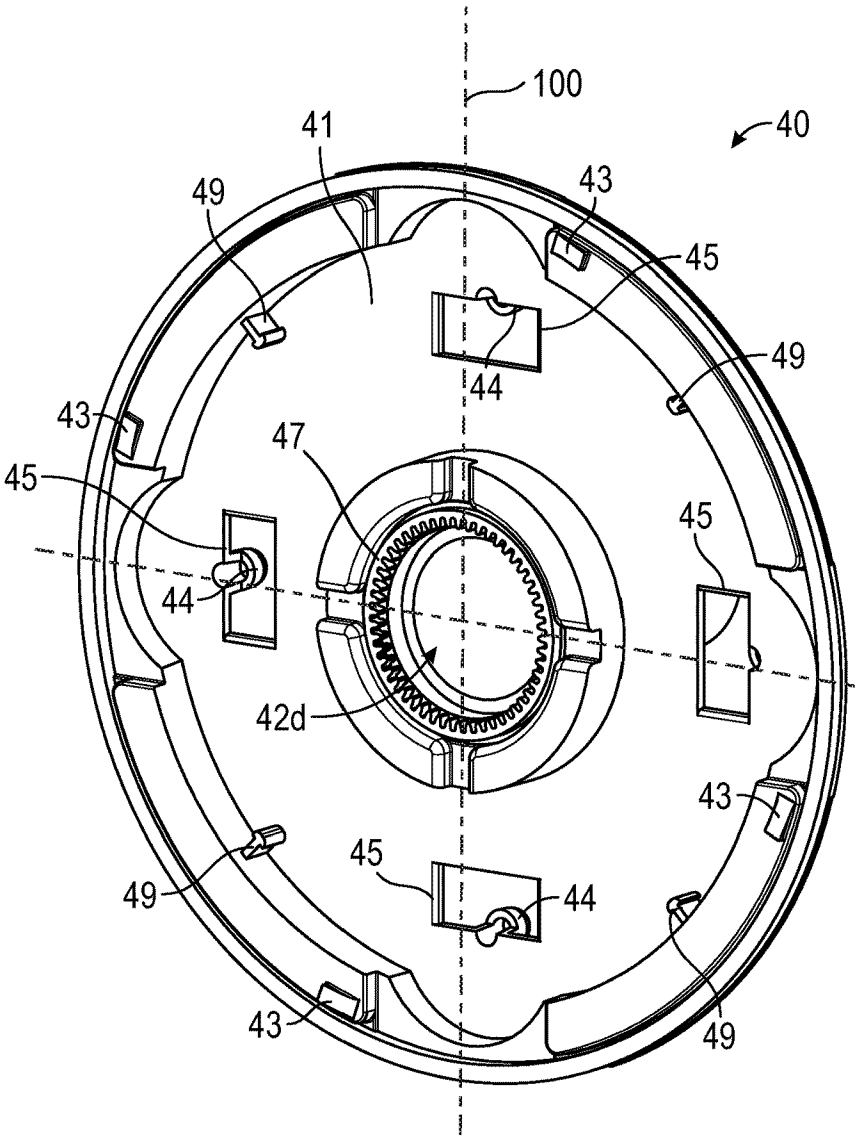

FIGS. 6A-6B illustrate back and front perspective views (respectively) of the carousel 40. As shown, the carousel 40 can include a body 41 and a projection 42 extending outwards from the body 41. As discussed in more detail below, the projection 42 can connect to the support frame 50, for example, via the base 52 of the support frame 50. In some variants, the projection 42 extends generally perpendicular from the body 41 or a portion of the body 41. The projection 42 can be positioned along an interior of the body 41, for example, at or near a center of the body 41. In some variants, the body 41 comprises a circular or disk-like shape. For example, the body 41 can comprise a perimeter having a circular shape. In some variants, the projection 42 comprises a cylindrical shape. In some variants, the projection 42 comprises a circular cross-section. In some implementations, the projection 42 can have a square, rectangular, or other shaped cross-section.

As illustrated, the projection 42 can include a "free" (e.g., cantilevered) end 42*a*. The free end 42*a* can be configured to connect with the base 52 of the support frame 50. The free end 42*a* of the projection 42 can include one or more holes 42*b* (such as one, two, three, four, or more holes 42*b*) that can be configured to receive fasteners (e.g., screws) to facilitate the connection with the base 52 of the support frame 50. For example, each of a plurality of fasteners (e.g., screws) can pass through a respective one of a plurality of through-holes 52*d* in the base 52 and secure within a respective one of the one or more holes 42*b*. In some variants, the one or more holes 42*b* are threaded.

In some variants, the projection 42 of the carousel 40 includes an inner projection 42*c*. The inner projection 42*c* can be inset from (e.g., spaced inwards from) a perimeter of the end 42*a* of the projection 42. The inner projection 42*c* can have a cylindrical shape in some embodiments (see FIG. 6B). The inner projection 42*c* can be sized and/or shaped to fit and/or secure within an inner rim 52*e* of the base component 52 (see FIG. 8A).

As shown in FIGS. 6A-6B, the carousel 40 can include one or more stubs 44, such as one, two, three, four, five, six, seven, or eight or more stubs 44. The one or more stubs 44 can extend outward from (e.g., generally perpendicularly) a portion of the carousel 40 (e.g., a portion of the body 41). As discussed further herein, each of the one or more stubs 44 can support an end of a roll of consumable product, such as an end of one of tissue rolls 14*a*, 14*b*, 14*c*, 14*d*. As also discussed further below, the one or more stubs 44 of the carousel 40 can act in tandem with one or more stubs 56 on the support frame 50 to support one or more tissue rolls 14*a*, 14*b*, 14*c*, 14*d* within an interior of the dispenser 10. For example, the stub(s) 44 of the carousel 40 and the stub(s) 56 of the support frame 50 can support opposite ends of tissue rolls 14*a*, 14*b*, 14*c*, 14*d*.

The carousel 40 can include one or more openings 45. The openings 45 can be configured to receive a portion of the actuator 82 as discussed in more detail below. For example, the carousel 40 can include one, two, three, four, five, six, seven, or eight or more openings 45. The one or more openings 45 can be spaced apart one another along the body 41. In some embodiments, the one or more openings 45 are circumferentially and/or substantially equally spaced along the body 41 around the projection 42 of the carousel 40. For example, with reference to FIGS. 6A-6B, the carousel 40 can include a plurality of openings 45 (e.g., four openings 45) that are circumferentially spaced around the cavity 42*d* of the carousel 40. The carousel 40 can include a plurality of openings 45 (e.g., two openings 45) that are aligned along a first (e.g., vertical) axis 100 of the carousel 40 and/or a plurality of openings 45 (e.g., two openings 45) that are aligned along a second (e.g., horizontal) axis 200 of the carousel 40. The carousel 40 can include a plurality of openings 45 that are circumferentially and/or equally spaced around a third axis 300 of the carousel 40 that is perpendicular to both the first and second axes 100, 200 (see FIG. 6B). Each of the one or more openings 45 can be spaced an equal distance (e.g., radial distance) from a center of the carousel 40 represented by the intersection of axes 100 and 200. For example, each of the one or more openings 45 can be equally, radially spaced from the axis 300, which can extend perpendicular to the axes 100, 200 at the intersection thereof.

In some variants, each of the one or more stubs 44 of the carousel 40 are positioned proximate a respective one of the openings 45. For example, each of the one or more stubs 44 can be positioned adjacent an edge of a respective opening 45. As discussed further below, such configuration can advantageously allow a portion of the actuator 82 to contact an end of a tissue roll (via extension through an opening 45) that is supported by a stub 44 positioned proximate the opening 45. The number of openings 45 and/or stubs 44 can correspond with a number of tissue rolls desirably supported within the dispenser 10. In some variants, the carousel 40 includes one, two, three, four, five, or six or more pairs of stubs 44 and openings 45. Thus, although the figures illustrate a carousel 40 having four pairs of stubs 44 and openings 45, the disclosure is not limited to only that number and is broad enough to encompass embodiments with other numbers of stubs 44 and openings 45.

As discussed further below, the openings 45 can be configured to receive a portion of the actuator 82, for example, when the actuator 82 moves to a second position in which it extends through one of the openings 45. The openings 45 can be sized and/or shaped to accommodate a size and/or shape of the actuator 82 and/or a portion thereof. The openings 45 can be rectangular or another shape, such as square, circular, among others.

Figure 6D:
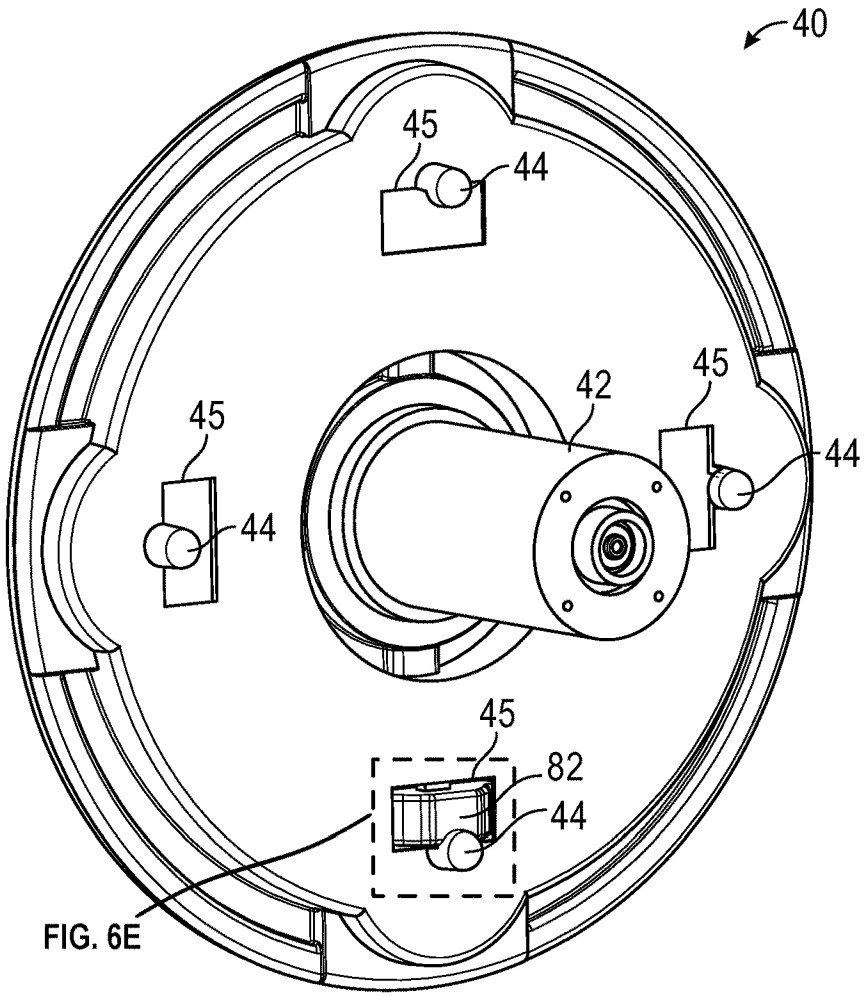
FIGS. 6C-6D illustrate perspective views of the carousel of FIGS. 6A-6B with additional components secured thereto in accordance with aspects of this disclosure.
Figure 6C:
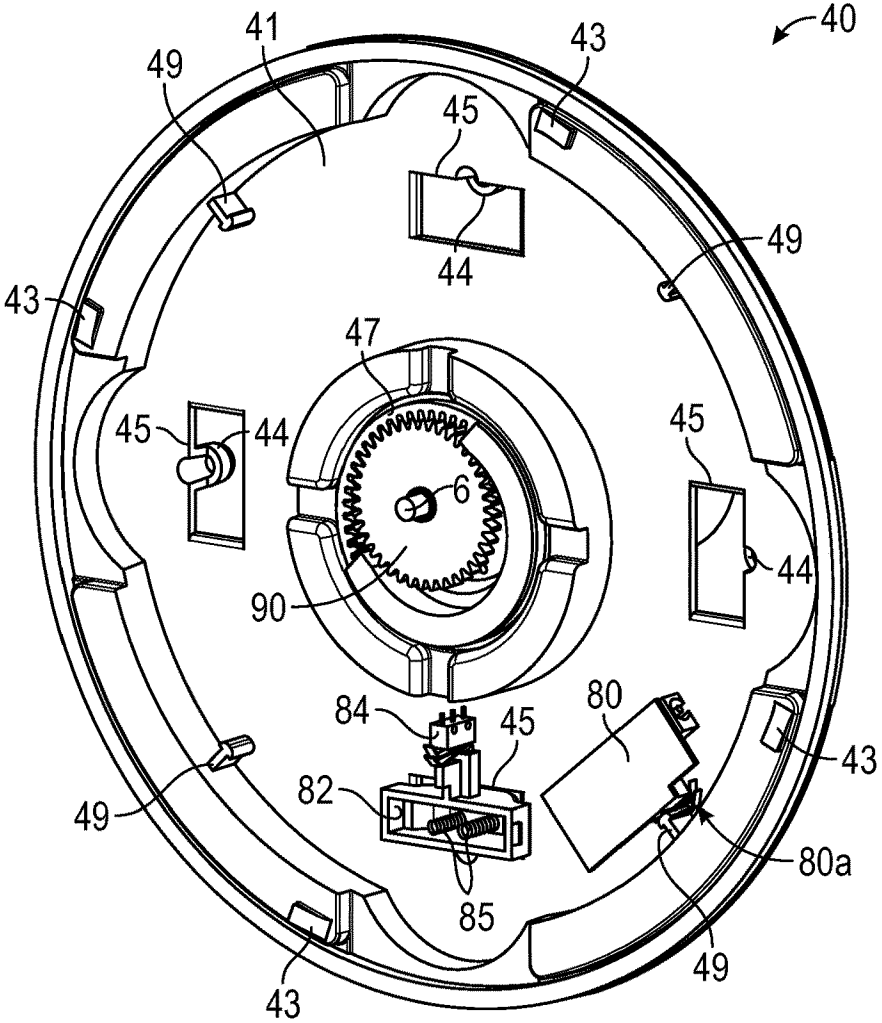
Figure 6E:
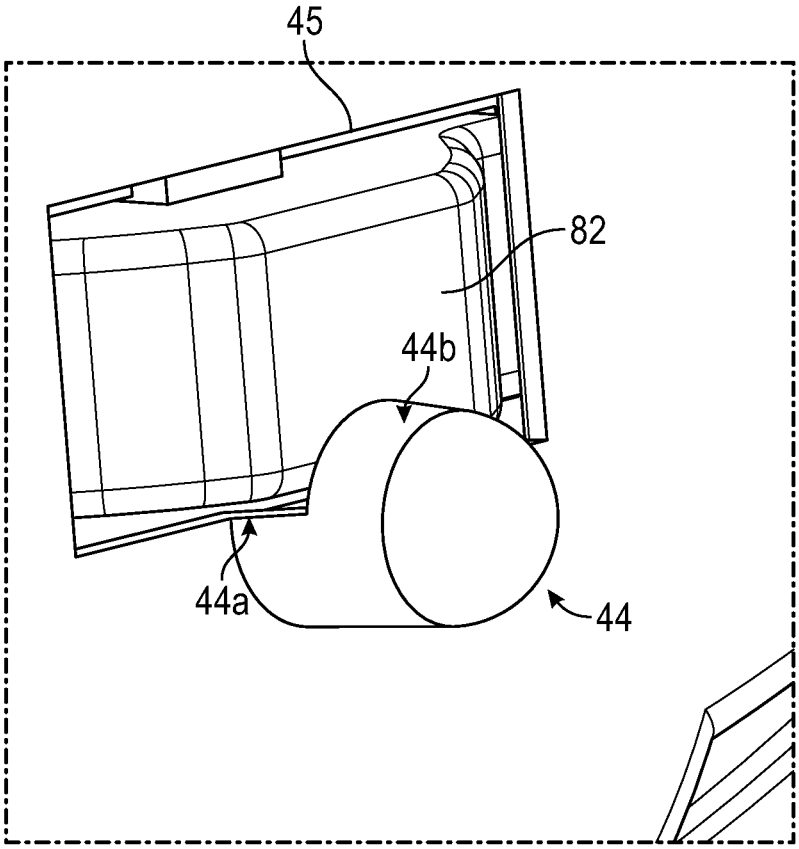
FIG. 6E illustrates an enlarged perspective view of a portion of the carousel shown in FIG. 6D in accordance with aspects of this disclosure.
Figure 6F:
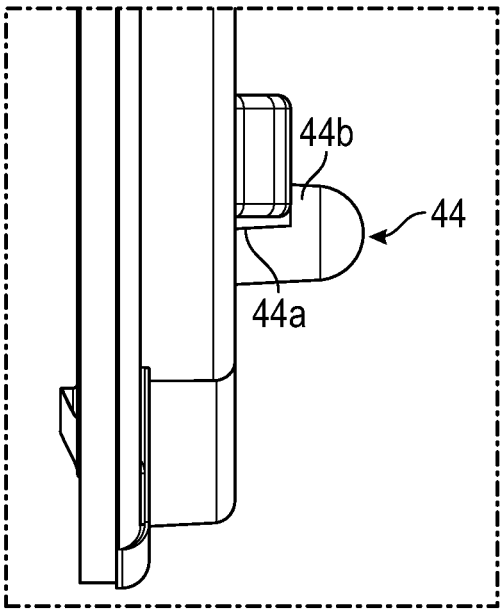
FIG. 6F illustrates an enlarged side view of a portion of the carousel shown in FIG. 6D in accordance with aspects of this disclosure.
Figure 6G:
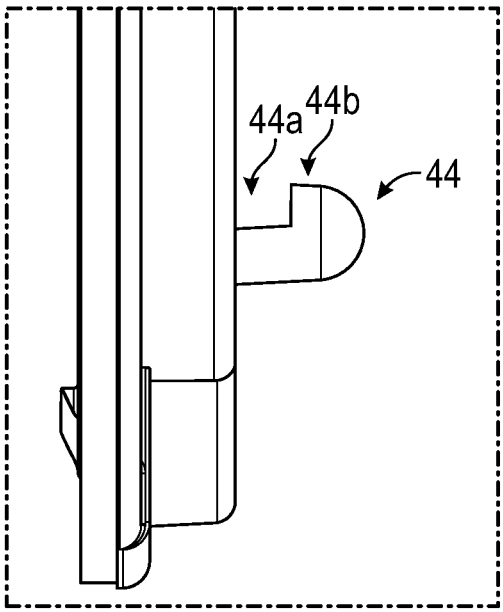
FIG. 6G illustrates the enlarged side view of FIG. 6F with an actuator removed in accordance with aspects of this disclosure.

With reference to FIGS. 6A-6B and 6G and as discussed above, the one or more stubs 44 can extend from the body 41 of the carousel 40 adjacent the one or more openings 45. The stubs 44 can include a first portion 44*a* connected to the body 41 and a second portion 44*b* connected to the first portion 44*a*. In some variants, the first portion 44*a* can be notched and/or can comprise a smaller cross-sectional area than the second portion 44*b*. As discussed further below with reference to FIGS. 6E-6F and FIGS. 11A-11C, the first portion 44*a* can be sized and/or shaped to allow a portion of the actuator 82 to pass through the opening 45 and contact (or be proximate to) the second portion 44*b* when the actuator 82 moves to a second position (FIG. 11C). As also discussed further below, the actuator 82 can move to such second position when a diameter of a tissue roll supported by the stub 44 is below a threshold value. In some variants, the stubs 44 (e.g., the second portion 44*b*) comprises a rounded end. In some variants, the stubs 44 comprise an end configured to fit within a "core" (e.g., a paperboard core) of a tissue roll. However, the stubs 44 can alternatively or additionally comprise an end that is configured to support and/or secure a "coreless" tissue roll. In some variants, the stubs 44 comprise ends having a circular cross-section.

As discussed above, in some variants, the roll support assembly 8 of the dispenser 10 is configured to support a plurality tissue rolls on one side. For example, in some variants, the roll support assembly 8 can include only the carousel 40 and not the support frame 50, and each of the stubs 44 of the carousel 40 can be configured to support one of the plurality of tissue rolls. For example, in some variants, the stubs 44 can extend from the body 41 of the carousel 40 and can be sized and/or shaped to extend through width of each of the rolls (e.g., through a "core" of the rolls) in order to provide support for the rolls. For example, the stubs 44 can be rods that extend outward from the body 41 of the carousel 40 which are sized and/or shaped to be received through a "core" of each of the rolls. Accordingly, while the figures illustrate the stubs 44 of the carousel 40 supporting the plurality of tissue rolls 14*a*, 14*b*, 14*c*, 14*d* along with the stubs 56 of the support frame 50, the stubs 44 can be configured to support the plurality of tissue rolls 14*a*, 14*b*, 14*c*, 14*d* alone.

As shown in FIGS. 6A-6B, the carousel 40 can include one or more tabs 43, such as one, two, three, four, five, six, seven, or eight or more tabs 43. The one or more tabs 43 can extend outward from a surface of the body 41 of the carousel 40 and can be configured to engage the tab 28 of the cabinet 20 in order to inhibit (e.g., prevent) rotation of the carousel 40 relative to the cabinet 20 in either a clockwise or counterclockwise direction, as discussed above. In some variants, the tabs 43 are rectangular shaped, however, such shape does not limited the disclosure. The tabs 43 can be square or circular shaped, among other shapes. The tabs 43 can be ramped or otherwise cammed, such as in the direction of rotation of the carousel 40.

In several embodiments, the tabs 43 of the carousel 40 and tab 28 of the cabinet 20 interface to restrict rotation of the roll support assembly 8 (e.g., the carousel 40 and/or the support frame 50) to one rotational direction. For example, the interface of the tabs 43 and tab 28 can restrict manual rotation of the carousel 40 (e.g., via knob 11) by a user to one rotational direction (e.g., only clockwise or only counterclockwise) so that a new (unexhausted roll) is positioned proximate the opening 12 when the knob 11 is operated. This can passively instruct a user and/or eliminate "guesswork" regarding which direction to rotate the knob 11 (and thus the roll support assembly 8).

FIGS. 6C-6D illustrate the same perspective views of the carousel 40 shown in FIGS. 6A-6B with additional components of the dispenser 10 shown proximate and/or connected to the carousel 40 for purposes of presentation. As discussed above, the dispenser 10 can include the motor 6 that is configured to rotate the roll support assembly 8. With reference to FIGS. 4, 6A, and 6C, the motor 6 can be coupled to a gear 90 which can engage (e.g., mate with) threads or teeth 47 of the carousel 40. For example, the motor 6 can be configured to rotate the gear 90, and, via interaction between the gear 90 and the teeth 47 of the carousel 40, can thereby be configured to rotate the carousel 40. Further, because the carousel 40 can be connected to the support frame 50 (e.g., via the base component 42), such rotation of the carousel 40 can also cause rotation of the support frame 50. As shown in FIG. 6A, the carousel 40 (e.g., the body 41) can include teeth 47 radially disposed around an inner perimeter of a cavity 42*d* within the projection 42, which can be cylindrical in some variants. The position of the teeth 47 can vary, for example, depending on the location of the projection 42 with respect to the body 41 of the carousel 40. In some variants, the teeth 47 are disposed radially around a center axis of the carousel 40 that extending through a length of the projection 42.

FIG. 6C illustrates the carousel 40 and the switch 84, the actuator 82, one or more springs 85, and the printed circuit board 80, without also showing certain other components (e.g., the cabinet 20). As discussed above, the switch 84, the actuator 82, one or more springs 85, and the printed circuit board 80 can be supported by and/or secured to portions of the cabinet 20. FIG. 6C further illustrates a back perspective view of a position of the switch 84 and the actuator 82 relative to an opening 45 of the carousel 40 while FIG. 6D illustrates a front view of such configuration. As can be seen from FIG. 6D, a portion of the actuator 82 can extend through one of the openings 45 of the carousel 40 when the carousel 40 is rotatably positioned relative to the cabinet 20 as shown. As discussed further below, the actuator 82 can be configured to extend through the openings 45 of the carousel 40 when the openings 45 are aligned with the actuator 82. As also discussed below, the actuator 82 can be configured to retract (e.g., partially or completely) when contacted by portions of the body 41 of the carousel 40 and/or by ends of tissue rolls. For example, the actuator 82 can be configured to partially retract (e.g., inwards relative to the cavity 27) when the carousel 40 rotates from a first position where one of the openings 45 is proximate the actuator 82 to a second position where a different one of the openings 45 is proximate the actuator 82.

Various embodiments of the dispenser 10 are configured to determine a position of the carousel 40. As shown in FIGS. 6A and 6C, the carousel 40 can include one or more indicator protrusions 49, such as one, two, three, four, five, six, seven, or eight or more indicator protrusions 49. The indicator protrusions 49 can extend outward from and/or along a portion of the body 41 of the carousel 40. The indicator protrusions 49 can engage the switch 80*a* that is in communication and/or connected with the printed circuit board 80 when the carousel 40 is rotated with respect to the cabinet 20. For example, when the printed circuit board 80 is supported by and/or stationary with respect to the cabinet 20 in the position shown in FIG. 6C, one of the indicator protrusions 49 can contact (e.g., depress) the switch 80*a* coupled with the printed circuit board 80. Such interaction between the indicator protrusions 49, the switch 80*a*, and the circuit board 80 can advantageously allow the controller 3 of the dispenser 10 to determine a position (e.g., rotational position) of the carousel 40 relative to the cabinet 20 and/or the opening 12 of the dispenser 10 (FIG. 1C). For example, the relative position of the printed circuit board 80, switch 80*a*, indicator protrusions 49, actuator 82, and/or openings 45 can be selected such that one of the indicator protrusions 49 contacts the switch 80*a* when the actuator 82 is positioned proximate and/or through or partially through one of the openings 45. Further, the number of indicators protrusions 49 can correspond with the number of openings 45 of the carousel 40, and each of the indicator protrusions 49 can be associated with one of the openings 45. Accordingly, the indicator protrusions 49 and switch 80*a* can allow the controller 3 to determine whether to stop instructing the motor 6 to rotate the carousel 40. For example, after receiving an instruction from the controller 3 to rotate the carousel 40 (e.g., in response to a determination that the roll sensor mechanism 2 detected that a diameter of a tissue roll was below a threshold value), the controller 3 can then instruct the motor 6 to stop rotating the carousel 40 when one of the indicator protrusions 49 engages the switch 80*a*.

Second Support Frame

Figure 7B:
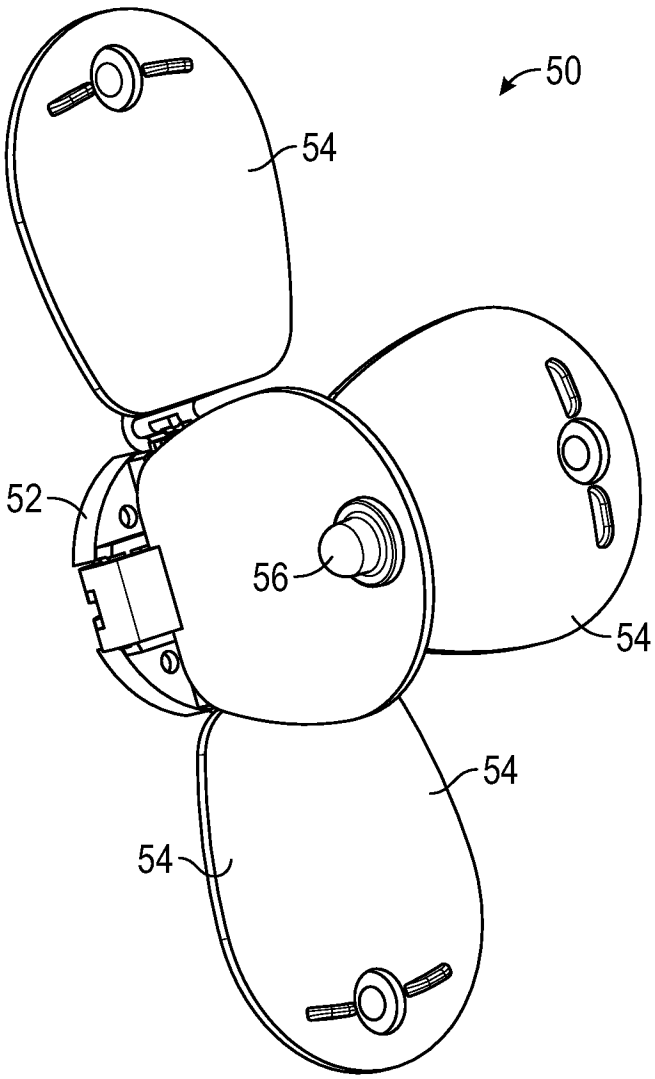
FIGS. 7A-7B illustrate various views of a support frame of the dispenser of FIG. 4.
Figure 7A:
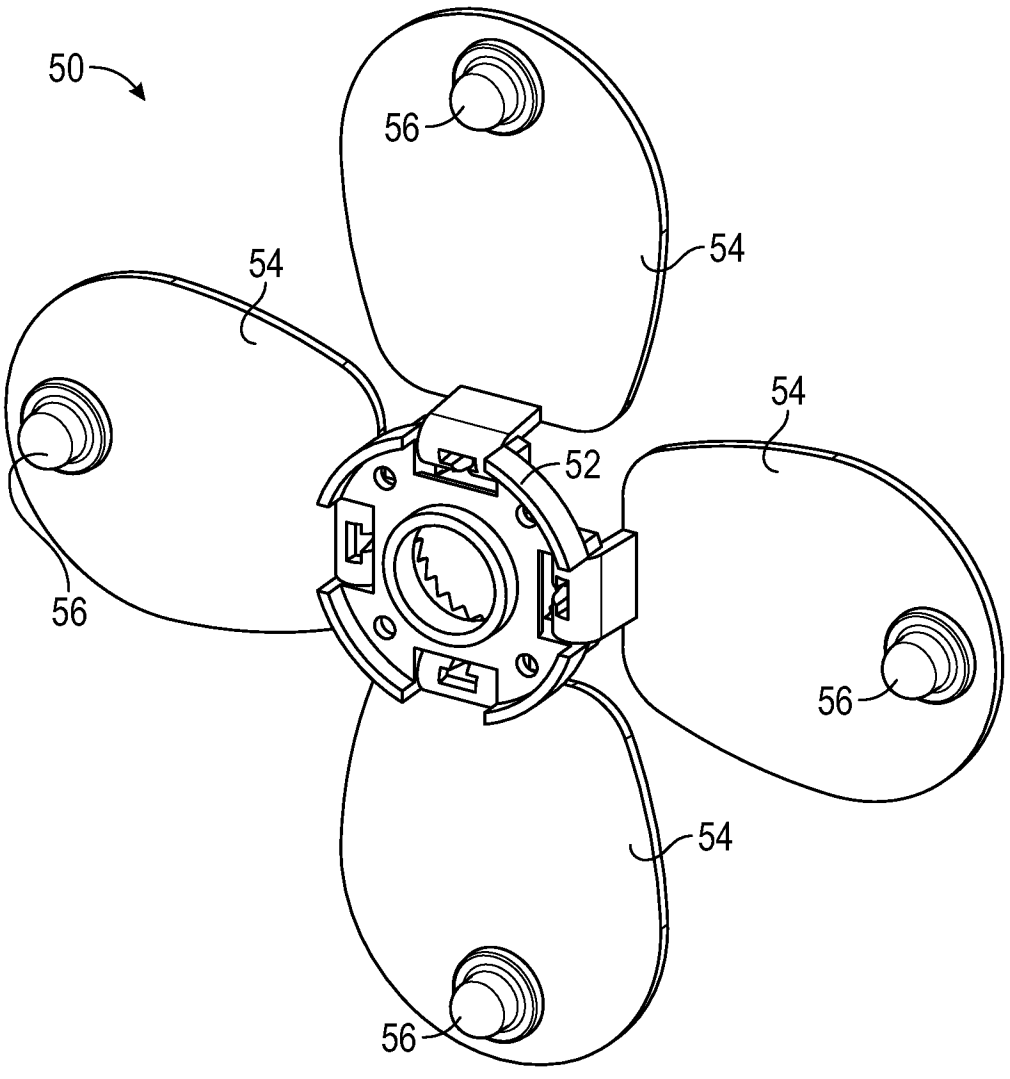

As discussed above, the roll support assembly 8 can include a second support frame 50 configured to support a second end of each of the one or more tissue rolls. FIGS. 7A-7B illustrate perspective views of the support frame 50. The support frame 50 can include a base component 52 (also referred to herein as "base") and a plurality of wings 54 coupled to the base component 52. For example, the support frame 50 can include one, two, three, four, five, six, seven, or eight or more wings 54 coupled to the base component 52. The support frame 50 can include a plurality of stubs 56 configured to support second ends of each of the tissue rolls. For example, the support frame 50 can include one, two, three, four, five, six, seven, or eight or more stubs 56. Each one of the plurality of stubs 56 can be positioned on a respective one of the plurality of wings 54. The base component 52 can connect to a portion of the carousel 40. For example, as discussed above, the base component 52 can secure to an end of the projection 42 of the carousel 40.

Figure 7C:
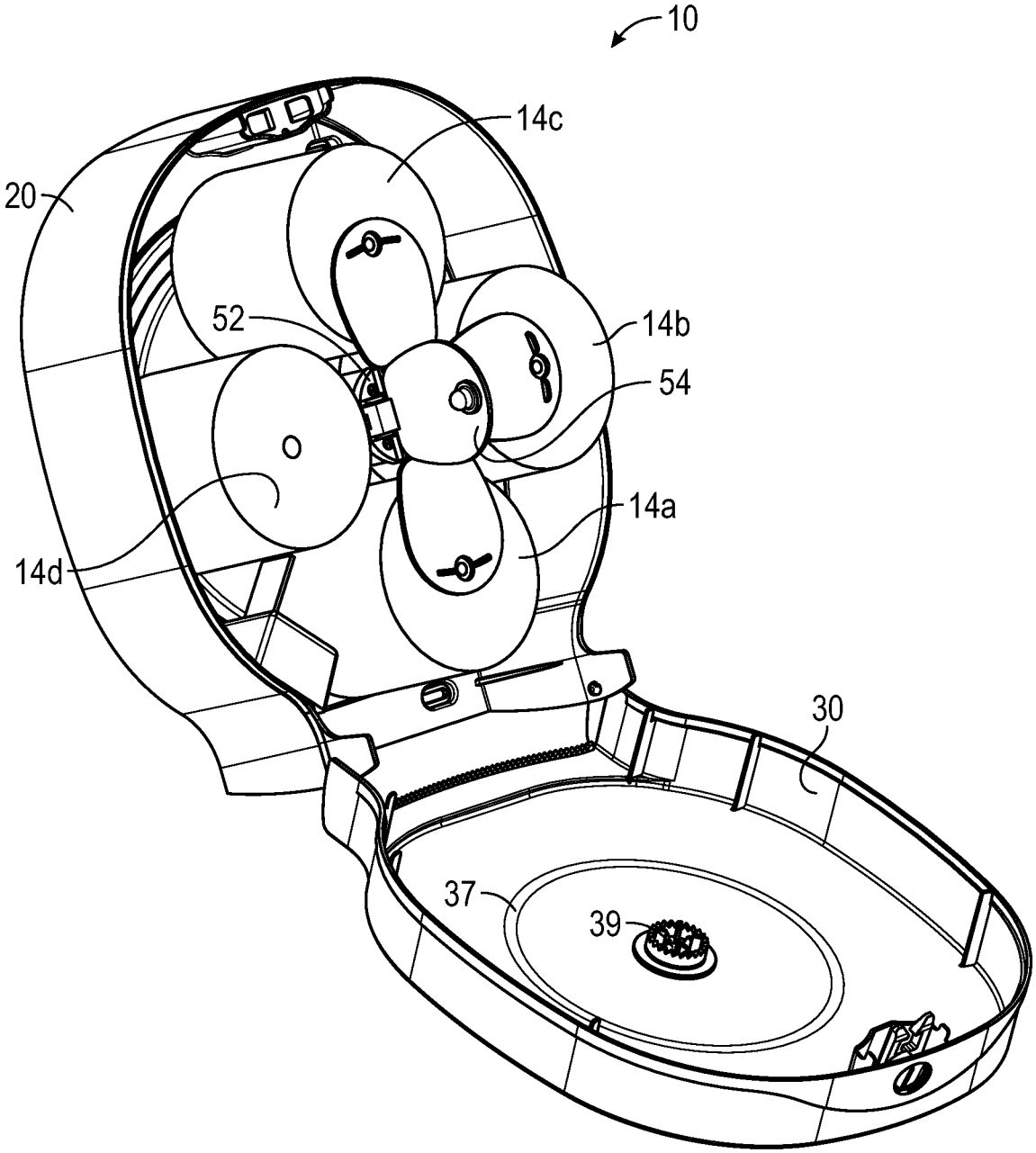
FIG. 7C illustrates another perspective view of the dispenser of FIGS. 1A-1C where the cover is in an open position and further illustrates one of the plurality of wings of the support frame of FIGS. 7A-7B in a second, open position in accordance with aspects of this disclosure.

As illustrated in FIGS. 7B-7C, the plurality of wings 54 can be pivotally connected to the base component 52. For example, the plurality of wings 54 can be configured to pivot between a first (e.g., closed) position (see FIG. 7A) and a second (e.g., open) position (see FIG. 7B-7C in which one of the wings has been moved to the open position). Such pivoting about the base component 52 can provide access to an interior of the dispenser 10 and allow a user to insert a new tissue roll within the dispenser 10. For example, pivoting of one of the wings 54 can allow a user to insert a new tissue roll 14*d* into the dispenser 10 (see FIG. 7C). As shown, the wings 54 can be configured to pivot outward, toward the cover 30, and/or in a direction that is generally perpendicular to the axis of rotation of the carousel 40. In some variants, the wings 54 slide relative to, or are removable from, the base 52.

The wings 54 can be independently movable. In some embodiments, the wings 54 are independently movable as a unit and/or individually. For example, in the embodiment illustrated, the wings 54 can move as a unit during the rotation of the second support frame 50 and can move individually when pivoted to receive a new roll. In some implementations, pivoting of one of the wings 54 does not pivot or otherwise move the other wings 54.

Figure 8B:
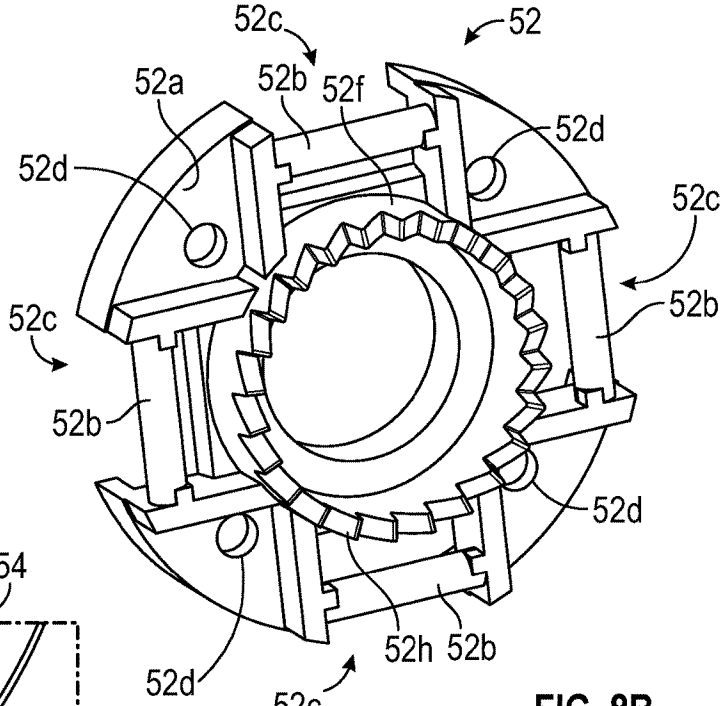
FIGS. 8A-8B illustrate perspective views of a base of the support frame of FIGS. 7A-7B.
Figure 8C:
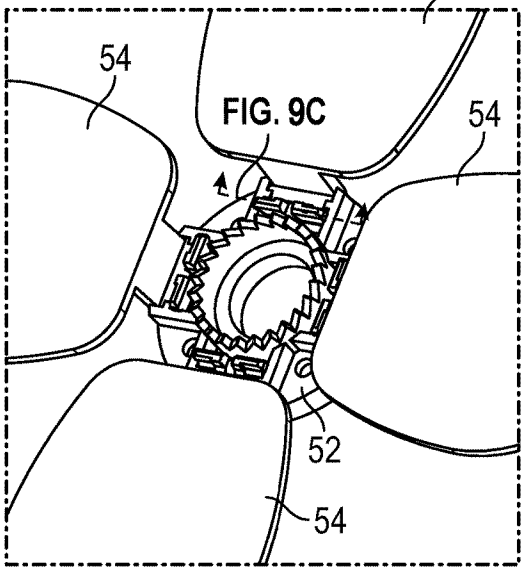
FIG. 8C illustrates an enlarged perspective view of a portion of the support frame of FIGS. 7A-7B.
Figure 8A:
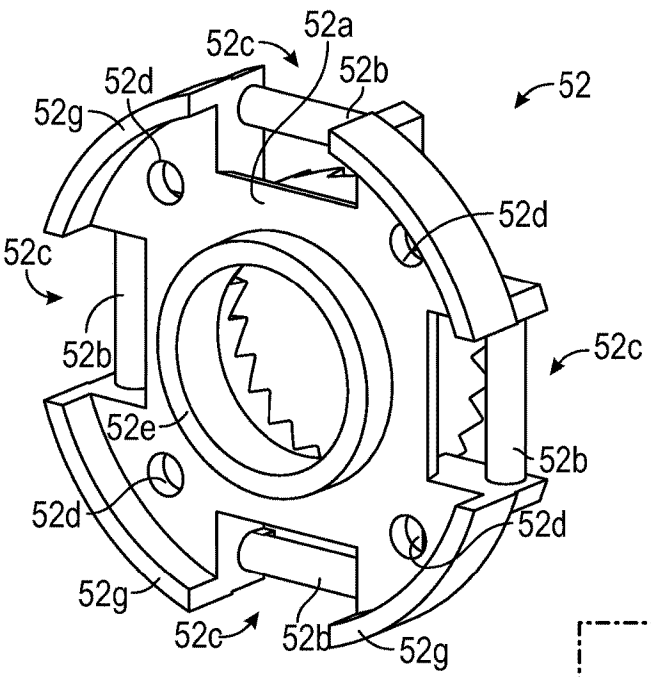

FIG. 8A illustrates a back perspective view of the base component 52 and FIG. 8B illustrates a front perspective view of the base component 52. The base component 52 can include a body 52*a*. The body 52*a* can include one or more slots 52*c* (also referred to herein as "channels") and one or more poles 52*b* extending across widths of the slots 52*c*. The body 52*a* can include one, two, three, four, five, six, seven, or eight or more slots 52*c* and one, two, three, four, five, or six, seven, or eight or more poles 52*b*. The body 52*a* can include a number of slots 52*c* and respective poles 52*b* as the number of wings 54 in the support frame 50. As discussed below, the wings 54 can couple to the base component 52, such as via the poles 52*b*. The body 52*a* can include one or more through-holes 52*d* configured to receive fasteners (e.g., screws), which can pass through the through-holes 52*d* and secure to the holes 42*b* on the end 42*a* of the projection 42 of the carousel 40.

In some variants, the body 52*a* of the base component 52 can include an inner rim 52*e* extending outwards from a surface of the body 52 (see FIG. 8A). In some variants, the inner rim 52*e* is cylindrical. The inner rim 52*e* can be configured to secure to (e.g., around) the inner projection 42*c* on the end 42*a* of the projection 42 of the carousel 40.

In some variants, the body 52*a* comprises an outer rim 52*g* extending around a perimeter of the body 52*a*. The outer rim 52*g* can be configured to secure (e.g., around) a perimeter of the end 42*a* of the projection 42 of the carousel 40. The outer rim 52*g* can be discontinuous around a perimeter of the body 42*a*. For example, the slots 52*c* can separate portion of the outer rim 52*g*.

As discussed above, the dispenser 10 can include a knob 11 configured to allow a user to manually rotate the roll support assembly 8 of the dispenser 10, for example, to position one of the tissue rolls proximate the opening 12 of the dispenser 10. The support frame 50 can be positioned adjacent the cover 30, which can include the knob 11. In some variants, the knob 11 is positioned on an outer portion of the cover 30 and is coupled with an engagement portion 39 which is positioned proximate an inner portion of the cover 30 (see FIG. 7C). The base component 52 of the support frame 50 can include an engagement portion configured to engage (e.g., mate with) the engagement portion 39 so that the base component 52 (and therefore the support frame 50) can be rotated when the knob 11 is rotated. For example, as shown in FIG. 8B, the base component 52 can include an engagement portion 52*f* that extends from a surface of the body 52*a*. The engagement portion 52*f* can be cylindrical and have teeth 52*h* disposed along a perimeter of a free (e.g., cantilevered) end of the engagement portion 52*f*. Such teeth 52*h* can engage with teeth of the engagement portion 39, thereby allowing rotation of the knob 11 to cause rotation of the base component 52 and/or the wings 54 coupled with the base component 52. Further, when the base component 52 is connected with the projection 42 of the carousel 40 as discussed previously, rotation of the base component 52 from the knob 11 and engagement portion 39 can in turn cause rotation of the carousel 40. When one or more tissue rolls are support by the carousel 40 and/or the support frame 50, such rotation can in turn cause rotation of the tissue rolls within an interior of the dispenser 10.

Figure 9A:
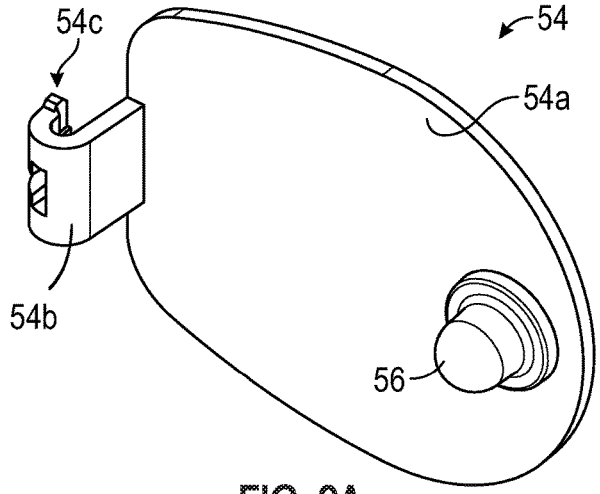
FIGS. 9A-9B illustrate perspective views of one of the plurality of wings of the support frame of FIGS. 7A-7B.
Figure 9B:
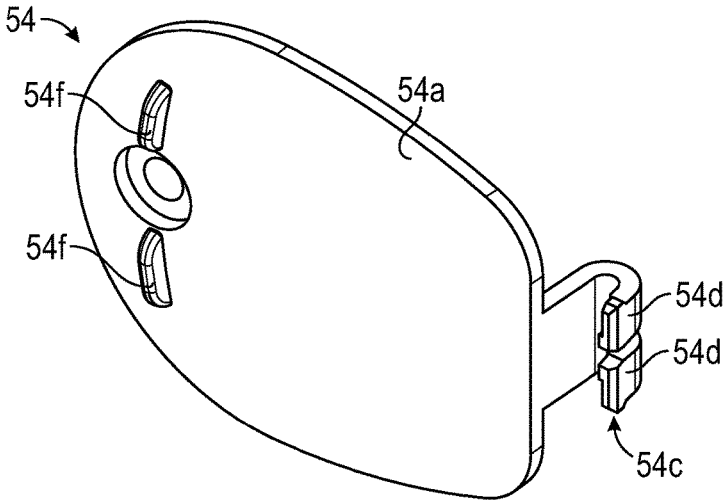

FIGS. 9A-9B illustrate perspective views of the wings 54. As shown, the wings 54 can include a body 54*a*, a stub 56, and a leg 54*b*. The stub 56 can extend outward from a surface of the body 54*a*. The stub 56 can be configured to support an end of a tissue roll, as discussed above. In some variants, the stub 56 comprises a circular cross-section. In some variants, the stub 56 has a rounded free (e.g., cantilevered) end. The stub 56 can be configured to fit within a "core" (e.g., a paperboard core) of a tissue roll. However, the stubs 56 can alternatively or additionally comprise an end that is configured to support and/or secure a "coreless" tissue roll.

The leg 54*b* can extend from a portion of a surface of the wing 54. In some variants, the leg 54*b* can be positioned at an end and/or perimeter of the body 54*a*. In some variants, the leg 54*b* is positioned at or near a first end of the wing 54 and the stub 56 is positioned at or near a second, opposite end of the wing 54. The leg 54*b* can extend from the body 54*a* and can have a curved free (e.g., cantilevered) end 54*c* that is configured to secure to (e.g., around) one of the poles 52*b* of the base component 52. For example, the end 54*c* of the leg 54*b* can be configured to secure and/or wrap around a portion of the pole 52*b*. In some variants, the leg 54*b* has a hook-shaped or J-shape. In some variants, the end 54*c* of the leg 54*b* comprises two leg portions 54*d*.

Figure 9C:
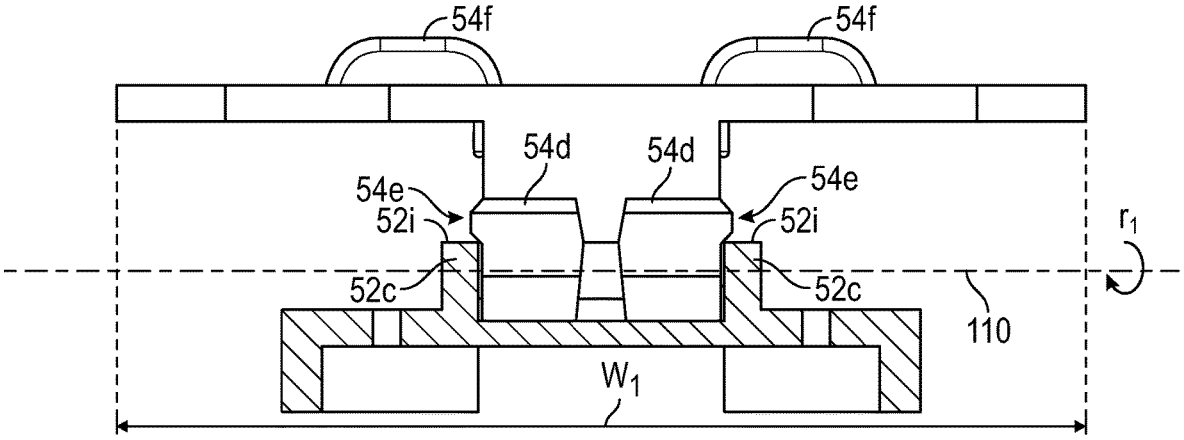
FIG. 9C illustrates a cross-section through a portion of FIG. 8C.
Figure 10A:
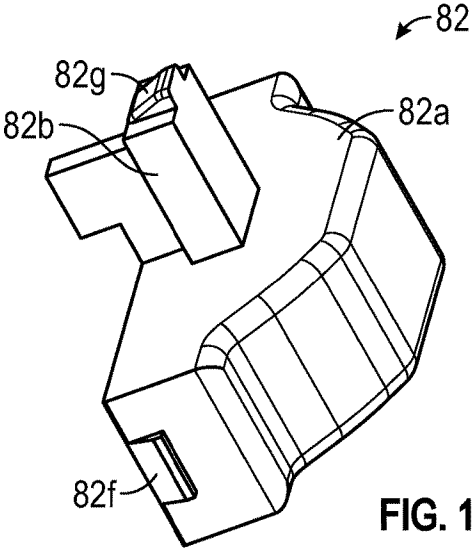
FIGS. 10A-10D illustrate various views of an actuator of the dispenser of FIG. 4.
Figure 10B:
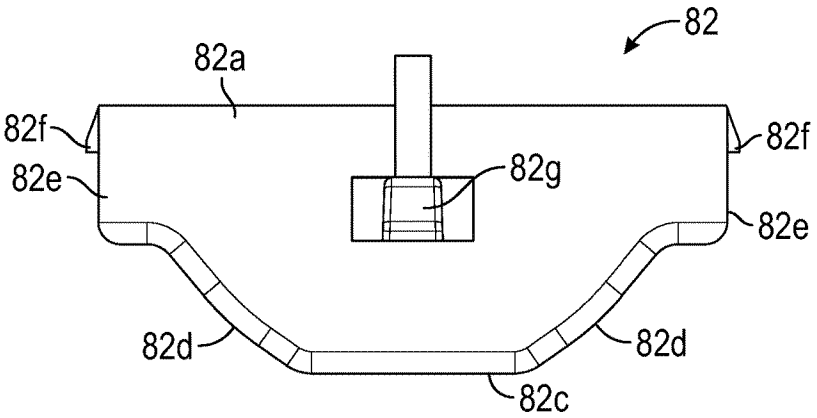
Figure 10C:
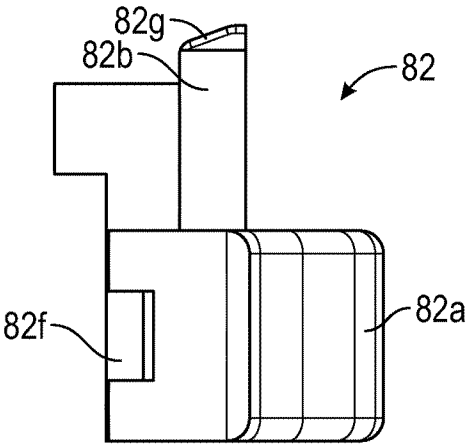
Figure 10D:
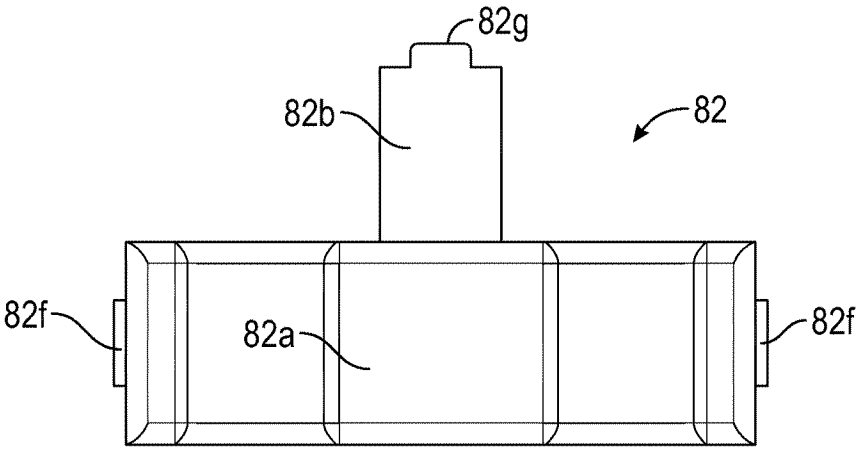

As discussed above, the wings 54 can be pivotally connected to the base component 52. For example, the wings 54 can be rotatably coupled to the poles 52*b* of the base component 52 via the legs 54*c*. The wings 54 can include a mechanism configured to limit or prevent "free" (e.g., uninhibited) rotation of the wings 54 about the poles 52*b*. FIG. 9C illustrates a cross-section taken through a portion of the support frame 50 that is illustrated in FIG. 8C and further illustrates an embodiment of such a mechanism. The end 54*c* of the leg 54*b* of the wing 54 can include one or more protrusions configured to contact a portion of the base component 52 and thereby inhibit the wing 54 from freely pivoting with respect to the base component 52. For example, the end 54*c* can include one or more protrusions 54*e* extending outwards (e.g., generally perpendicular) from a side or edge of the end 54*c*. The protrusions 54*e* can extend in a direction generally parallel to a width $W_1$ of the wing 54 (see FIG. 9C). In some variants where the end 54*c* of the leg 54*b* comprises two, separated leg portions 54*d*, a protrusion 54*e* can extend outward from a side or edge of each of the leg portions 54*d*, for example, as illustrated in FIG. 9C. The protrusions 54*e* can inhibit or prevent the wing 54 from freely rotating about the pole 52*b* in a certain rotational direction. For example, where the wing 54 is rotated about an axis 110 extending through the pole 52*b* in a first rotational direction $r_1$ (see FIG. 9C), the protrusions 54*e* can contact portions of a surface 52*i* of a channel 52*c* of the body 52*a* of the base component 52, thereby inhibiting (e.g., partially interfering with) "free rotation." In some variants, the wing 54 can be rotated in the rotational direction $r_1$ until contacting the engagement portion 52*f* of the base component 52 (see FIGS. 7B and 8B). In some variants, the support frame 50 can comprise a biasing member that can be used to inhibit "free" rotation of the wings 54 relative to the base 52. Such biasing member can be, for example, a torsional spring that can contact a portion of the wing 54 (such as a surface of the body 54*a*) and/or a portion of the base 52.

The wing 54 can include one or more tabs configured to extend outwards from the body 54*a* of the wing 54 and limit a movement of the wing 54 during rotation of the support frame 50 within the interior of the dispenser 10. For example, the wing 54 can include one or more tabs 54*f* extending outwards from the body 54*a* of the wing 54. The wing 54 can include one, two, three, four, five, or six or more tabs 54*f*. Thus, while the figures illustrate the wing 54 having two tabs 54*f*, the disclosure is not so limited. In some embodiments, when the support frame 50 is positioned adjacent the cover 30 as shown in FIG. 4, the tabs 54*f* can extend from the body 54*a* towards an inner surface of the cover 30.

The tabs 54*f* can be configured to limit movement of the wings 54 relative to the cover 30 when the support frame 50 rotates within the dispenser 10. Rotation of the support frame 50 within the dispenser 10 may cause some of the wings 54 to inadvertently pivot about the base component 52 and contact the inner surface of the cover 30. Such contact between the wings 54 and the inner surface of the cover 30 may be loud and/or may cause damage to the wings 54. Additionally, movement of the wings 54 during rotation of the support frame 50 may cause the tissue rolls supported by the support frame 50 to be disengaged. The tabs 54*f* can advantageously limit or prevent the wings 54 ability to pivot and therefore can reduce or eliminate such negative effects. In some variants, the tabs 54*f* comprise wheels, bushings, or otherwise.

In some embodiments, the cover 30 includes a track configured to guide and/or receive the tabs 54*f* during rotation of the support frame 50. For example, with reference to FIGS. 4 and 8C, the cover 30 can include a track 37 to assist in alignment of the support frame 50 with respect to the cover 30 and/or to inhibit or prevent excess motion or pivoting of the wings 54 during rotation. In some embodiments, the track 37 comprises a channel bound by protrusions, such as rails protruding outward from an inner surface of the cover 30. In some embodiments, the track 37 comprises a channel recessed from the inner surface of the cover 30. The track 37 can be circular in some variants.

Roll Sensor Mechanism

Figure 5C:
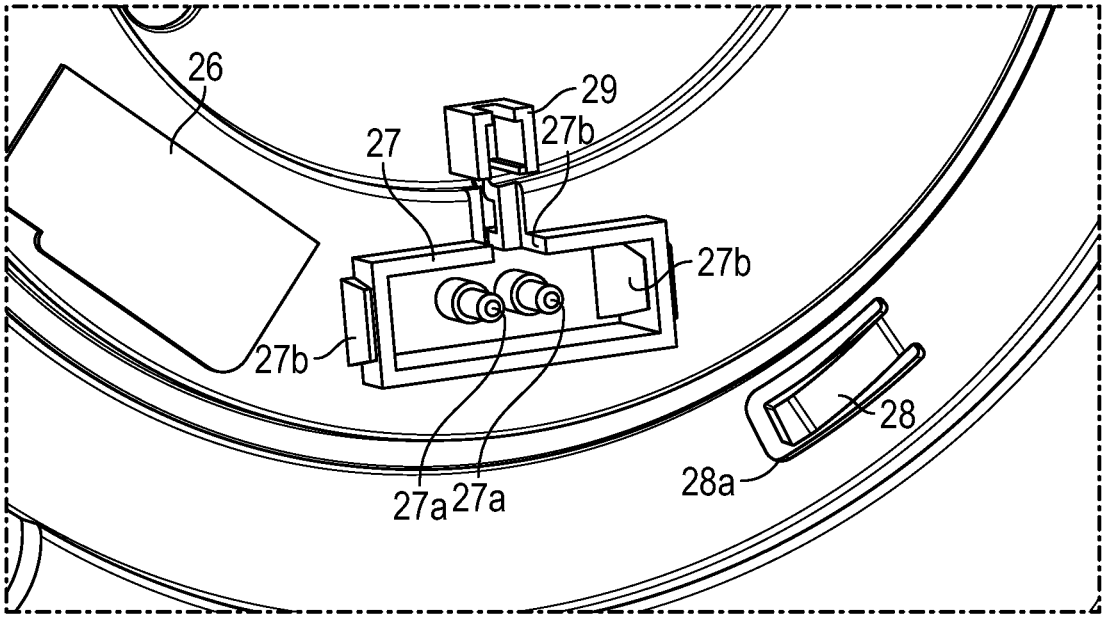
FIGS. 5C-5D illustrate enlarged views of portions of the cabinet shown in FIGS. 5A-5B in accordance with aspects of this disclosure.
Figure 5D:
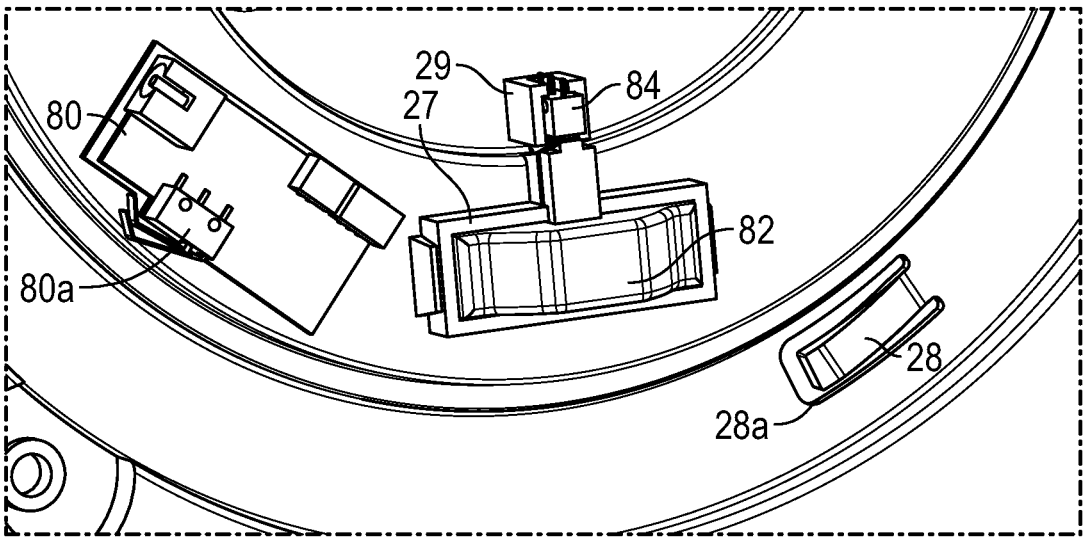

As discussed above, the dispenser 10 can include the roll sensor mechanism 2, which can be configured to detect a characteristic of at least one of the rolls. For example, the roll sensor mechanism 2 can be configured to detect the presence (or lack) of at least one of the rolls in a position in the dispenser 10, whether a diameter of one of the tissue rolls supported within the dispenser 10 is less than a threshold value, or otherwise. In some variants, the roll sensor mechanism 2 comprises the switch 84 and the actuator 82. As discussed above, the switch 84 and the actuator 82 can be supported by a portion of the cabinet 20, for example, within the cavities 29, 27 of the cabinet 20 (FIGS. 5C-5D).

FIGS. 10A-10D illustrate views of the actuator 82. The actuator 82 can include a body 82*a* and a tail 82*b* extending from the body 82*a*. The body 82*a* can be supported within the cavity 27 of the cabinet 20 (see FIGS. 5C-5D). As shown in FIGS. 5C-5D, the tail 82*b* can be positioned at least partially within the channel 27*b* extending between the cavity 27 and the cavity 29. The actuator 82 can include a tab 82*g* that can be configured to contact the switch 84 or a portion thereof. As discussed in more detail below with reference to FIGS. 11A-11C, the tab 82*g* can engage the switch 84 when the actuator 82 is in a first position (e.g., a retracted position) and can minimally contact or not contact the switch 84 when the actuator 82 is in a second position (e.g., an extended position). The body 82*a* can include engagement protrusions 82*f* on ends 82*e* of the body 82*a*. The engagement protrusions 82*f* can be configured to be received by guide slots 27*b* of the cavity 27 to help limit an amount of movement of the actuator 82 relative to the cavity 27 when supported within the cavity 27 (see FIG. 5C). The body 82*a* can include a front portion having a straight side 82*c* and angled sides 82*d* positioned on opposite sides of the straight side 82*c* and connected to the straight side 82*c*. The angled sides 82*d* can advantageously allow portions of the body 41 of the carousel 40 to more easily pass over the actuator 82 when the carousel 40 is rotated. For example, when the actuator 82 is in an extended position (e.g., extending through an opening 45 of the carousel 40) and the motor 6 rotates the carousel 40 in order to align a different opening 45 with the actuator 82 (e.g., to position a new tissue roll proximate the opening 12 of the dispenser 10), the body 41 of the carousel 40 can gradually move the actuator 82 towards the a retracted position when slidingly contacting one of the angled sides 82*d*.

Operation of the Dispenser

Various embodiments of the dispenser 10 can automatically detect that a roll of tissue has become exhausted and/or can automatically position a fresh roll of tissue in the opening 12. This can provide the user with an uninterrupted supply of tissue and/or avoid the user needing to interact with the dispenser 10 in order to access the fresh roll (which can be inconvenient for the user and/or can be unsanitary for the user to touch the dispenser).

Figure 11A:
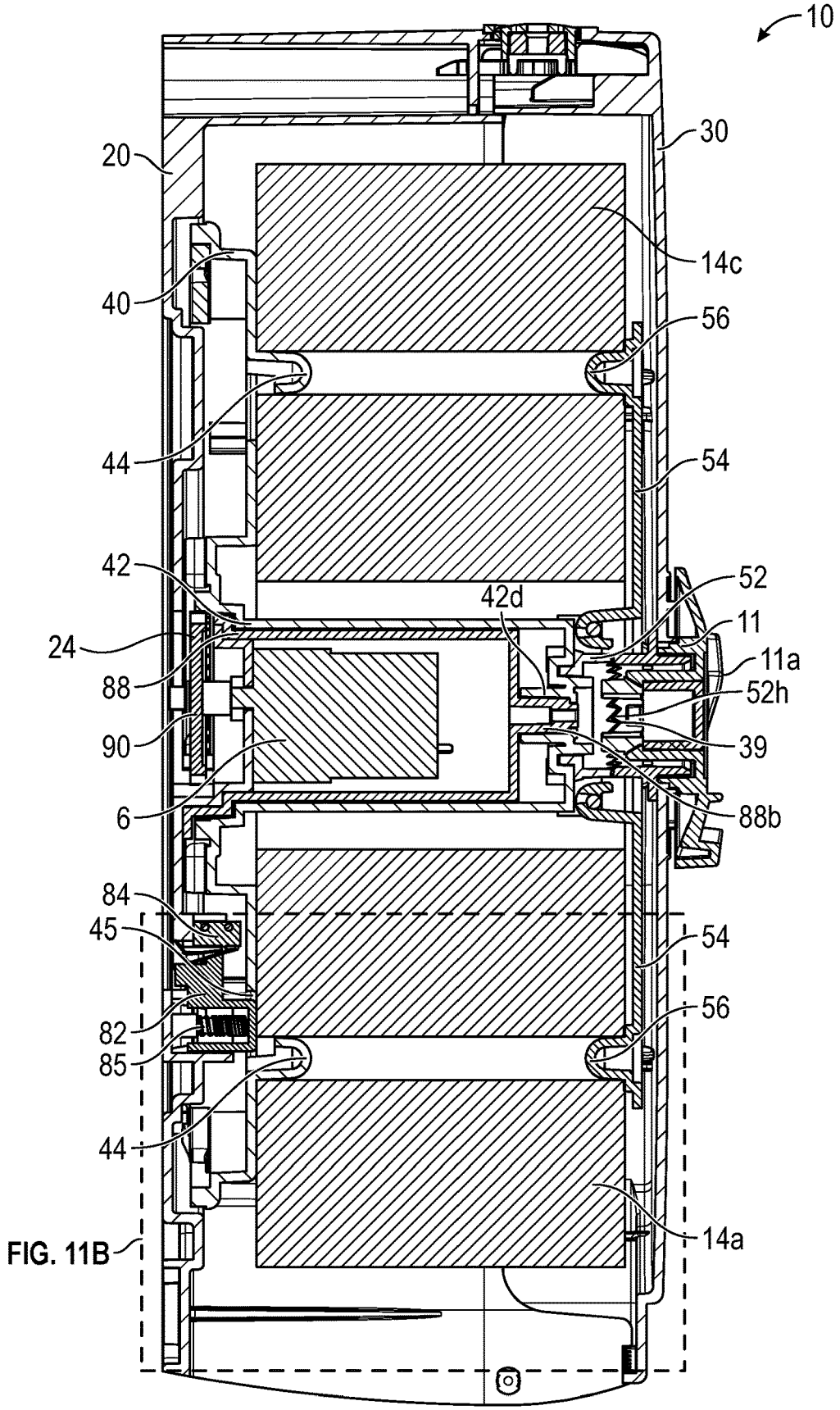
FIG. 11A illustrates a cross-section through a portion of the dispenser shown in FIG. 1D.

FIG. 11A illustrates a cross-section through the dispenser 10 shown in FIG. 1D. FIG. 11A further illustrates how the various components of the dispenser 10 shown in FIG. 4 are connected within the interior of the dispenser 10. FIG. 11A illustrates two tissue rolls 14*a* and 14*c* supported by stubs 44, 56 of the carousel 40 and support frame 50 (respectively) as described above. As discussed above, the dispenser 10 can include the roll sensor mechanism 2, which can be configured to detect whether a diameter of a tissue roll (e.g., tissue roll 14*a*) is below a threshold value. As also discussed, the controller 3 of the dispenser 10 can be configured to instruct the motor 6 to rotate the roll support assembly 8 (e.g., the carousel 40 and support frame 50) in response to such detection, in order to position a new tissue roll (e.g., tissue roll 14*b*) proximate the opening 12 of the dispenser 10. The roll sensor mechanism 3 can comprise the switch 84 and the actuator 82 as described previously.

Figure 11B:
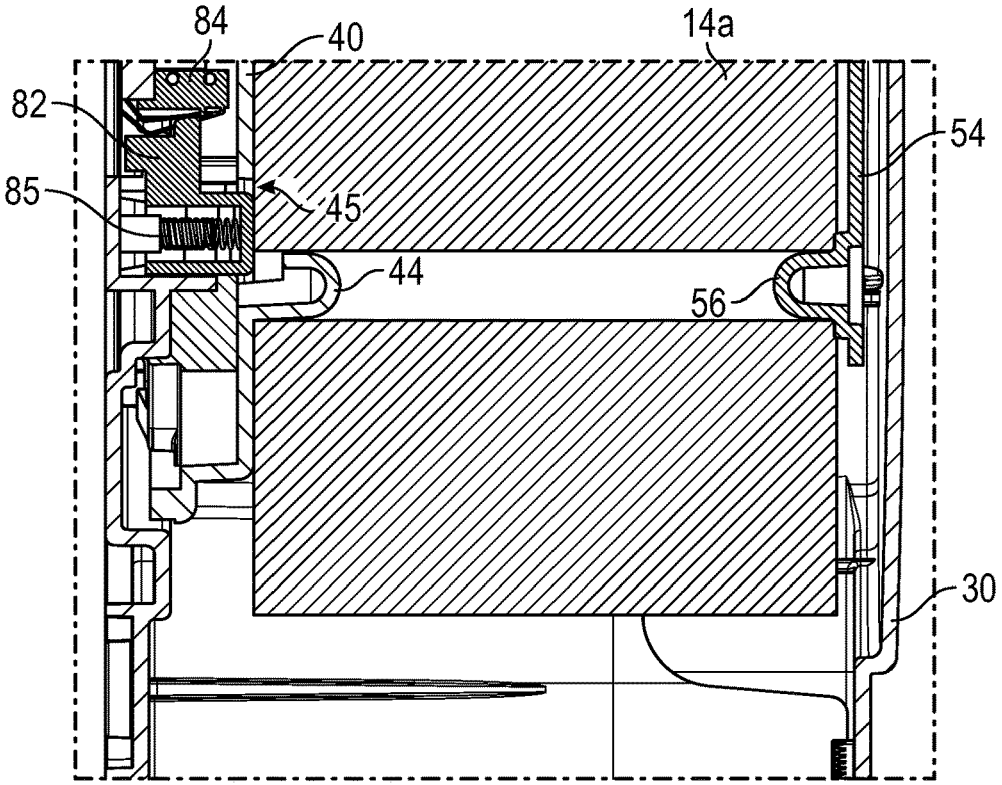
FIG. 11B-11C illustrate enlarged views of a portion of the cross-section shown in FIG. 11A in accordance with aspects of this disclosure.
Figure 11C:
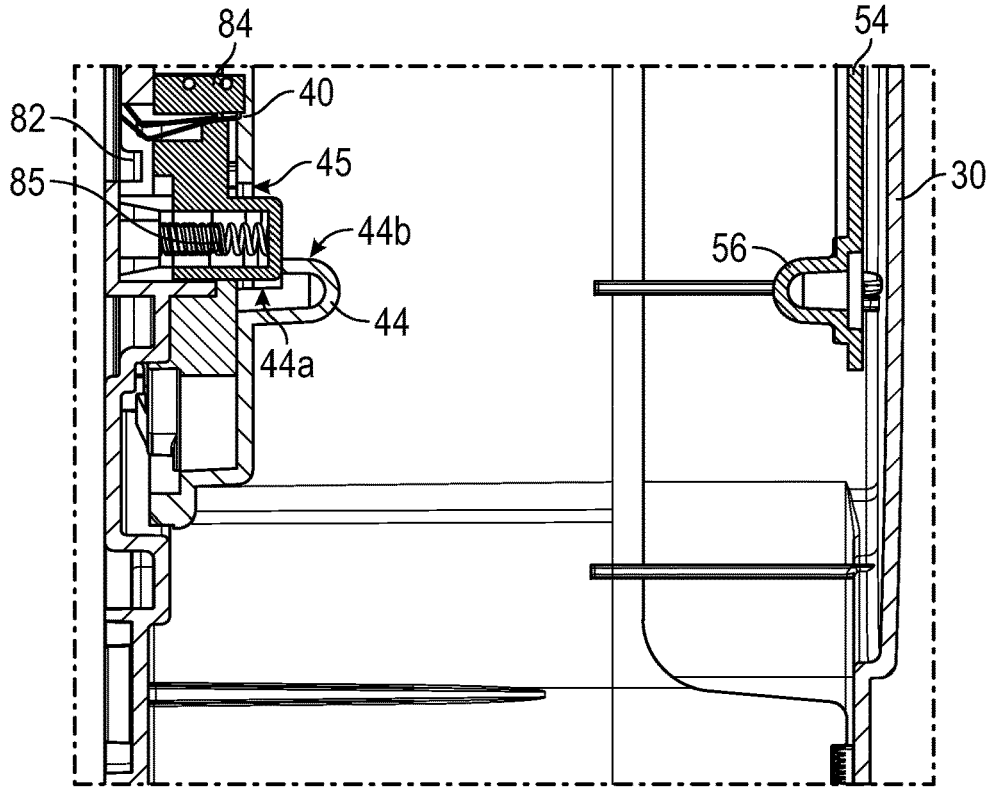

FIG. 11B illustrates an enlarged view of a portion of the cross-section shown in FIG. 11A where the tissue roll 14*a* is positioned between stubs 44, 56. As shown, although one of the openings 45 is positioned adjacent the actuator 82, the presence of the tissue roll 14*a* inhibits or prevents the actuator 82 from extending through the opening 45 (for example, to an extended position). As shown in FIG. 11C, when the tissue roll 14*a* is not positioned between the stubs 44, 56 or when the tissue roll 14*a* has been exhausted a certain amount, the actuator 82 can extend through the opening 45 to a neutral (e.g., "unstressed" or "resting") position. For example, when a diameter of the tissue roll 14*a* is equal to or greater than a threshold value, an end of the tissue roll 14*a* can present a physical interference that inhibits or prevents the actuator 82 from moving from a first position (e.g., the position shown in FIG. 11B) to a second position (e.g., the position shown in FIG. 11C). However, when the diameter falls below the threshold value, the physical interference is removed, thereby allowing the actuator 82 to move from the first position (FIG. 11B) to the second position (FIG. 11C).

As illustrated in FIG. 11B, the actuator 82 can engage the switch 84 (or a portion thereof) when in the first position. For example, the tab 82*g* of the tail 82*b* of the actuator 82 (see FIGS. 10A-10D) can contact the switch 84 or a portion thereof when in the first position. Additionally, as illustrated in FIG. 11C, the actuator 82 (e.g., the tab 82*g*) can minimally contact or not contact the switch 84 (or a portion thereof) when the actuator 82 is in the second position. The switch 84 can be in communication with the controller 3, and the controller 3 can register when the actuator 82 is in the first and/or second positions. In response to determining that the actuator 82 is in the second position (which can indicate that the diameter of the tissue roll 14*a* has decreased to less than or equal to the threshold value), the controller 3 can instruct the motor 6 to automatically rotate the carousel 40 and/or the support frame 50 to position a new tissue roll 14*b* proximate the opening 12. Such rotation can cause the actuator 82 to be positioned proximate to a different one of the openings 45 of the carousel 40 and in turn, an end of the new tissue roll 14*b*. Such process can be repeated each time a diameter of one of the tissue rolls 14*a*, 14*b*, 14*c*, 14*d* falls below a threshold value. Thus, provided that at least one of the tissue rolls has a diameter of at least the threshold value (e.g., is not exhausted), the dispenser 10 can supply the user with a constant supply of tissue.

As discussed above, the actuator 82 can be biased toward the second position (FIG. 11C) by one or more springs 85. As also discussed, the stubs 44 can include a notched portion 44*a* that can be sized to allow the actuator 82 to extend through the opening 45 towards the end portion 44*b* when moving to the second position. As also discussed, in some variants, the actuator 82 contacts the end portion 44*b* when in the second position. In some embodiments, the end portion 44*b* acts to limit an extension of the actuator 82 through the opening 45.

As discussed above, the actuator 82 can be configured to move to the extended position when a diameter (e.g., an outside diameter) of tissue roll 14*a* is equal to a threshold value. The threshold value can be zero (e.g., where is completely exhausted) or less than or equal to about: 5 mm, 10 mm, 20 mm, 30 mm, 40 mm, 50 mm, 60 mm, 70 mm, 80 mm, or 90 mm, or any value or range between any of such values, or other values. In some embodiments, the threshold value comprises an outside diameter of less than or equal to about: 51 mm, 64 mm, 77 mm, 89 mm, 102 mm, 114 mm, 127 mm, or any value or range between any of such values, or other values.

The positioning of the actuator 82 and/or the opening 45 with respect to stubs 44 of the carousel 40 can be altered to modify the "threshold value" discussed above. For example, while FIGS. 11A-11C illustrate the positioning of the actuator 82, openings 45, and stubs 44 such that the actuator 82 is inhibited from moving to the extended position until the tissue roll 14 is completely exhausted, such positioning could be altered. For example, the actuator 82 and/or the openings 45 can be spaced (e.g., radially) relative to the stubs 44 such that there is a gap between a bottom portion of the actuator 82 and an outer perimeter of the stubs 44. Where such "gap" exists, the physical interference of the tissue roll 14*a* that inhibits the actuator 82 from moving can be removed when the dimension of the material of the roll 14*a* beyond the outer perimeter of the stub 44 is equal to or less than such "gap" (see FIGS. 11A-11B). For example, the actuator 82 and/or the openings 45 can be spaced (e.g., radially) relative to the stubs 44 by a distance equal to 1 mm, 2 mm, 5 mm, 10 mm, 15 mm, 20 mm, or 25 mm, for example. In several embodiments, the greater the distance (e.g., radial distance) between the actuator 82 (and/or the openings 45) and the stubs 44, the greater the above-mentioned "threshold value" can be given that the stubs 44 can support and/or secure the tissue rolls 14*a*, 14*b*, 14*c*, 14*d* at centers of ends of the rolls. For example, the threshold value, which can represent an outside diameter of the tissue roll 14*a*, can be larger if the actuator 82 (and/or the openings 45) are spaced (e.g., radially) from the stubs 44 by a greater distance. Such "gap" can be advantageous where the tissue rolls 14*a*, 14*b*, 14*c*, 14*d* have a paperboard core that has a cross-sectional area similar to or slightly larger than the outer perimeter of the stubs 44 (and/or the end portion 44*b* of the stubs 44). For example, in such cases, such "gap" can prevent ends of the paperboard cores from obstructing the actuator 82 from moving to the extended position even after the consumable material surrounding the paperboard core is exhausted.

As discussed above, the roll sensor mechanism 2 can comprise, as an alternative or addition to the switch 84 and actuator 82, a proximity sensor (e.g., optical sensor) configured to detect whether a diameter of one of the tissue tolls is less than a threshold value without physically contacting the tissue rolls. Such proximity sensor can be placed, for example, in a position similar or identical to that shown with respect to the actuator 82 in FIGS. 11A-11C. For example, such proximity sensor could be placed so that it is aligned with an axis extending through the one of the springs 85 in FIGS. 11B-11C.

In some embodiments, the dispenser 10 includes a flange extending across and/or through a rotational path of the roll support assembly 8 and configured to inhibit or prevent rotation of the roll support assembly 8 when one of the tissue rolls is greater than a threshold value. For example, with reference to FIGS. 3A-3B and 4, the dispenser 10 can include the housing 70 connected to and/or supported by a portion of the cabinet 20 and a flange 70*a* extending from the housing 70. The flange 70*a* can extend across a rotational path of one of more of the tissue rolls 14*a*, 14*b*, 14*c*, 14*d* and can contact a portion of one of the tissue rolls (such as tissue roll 14*a*) when a diameter of the roll is equal to or greater than a threshold value. For example, with reference to FIGS. 3A-3B, when the diameter of the tissue roll 14*a* is greater or equal to a threshold diameter, the flange 70*a* can contact a portion of the tissue roll 14*a* and inhibit or prevent the roll support assembly 8 from rotating. Once the diameter of the tissue roll 14*a* is reduced to less than or equal to the threshold value (e.g., is exhausted), the roll support assembly 8 can rotate at least partially passed the flange 70. The flange 70*a* can be sized and/or shaped to correspond with the desired "threshold value" that is discussed above. For example, the length of the flange 70*a* can be sized such that a distance (e.g., radial) between a center axis of the stubs 44, 56 and a tip of the flange 70 establishes and/or define the "threshold value." In various embodiments, the flange 70*a* presents a physical interference to rotation of the roll (e.g., in the clockwise direction in FIG. 3A) until the roll's diameter is less than or equal to the threshold value.

Another Embodiment for Dispenser

Figure 12:
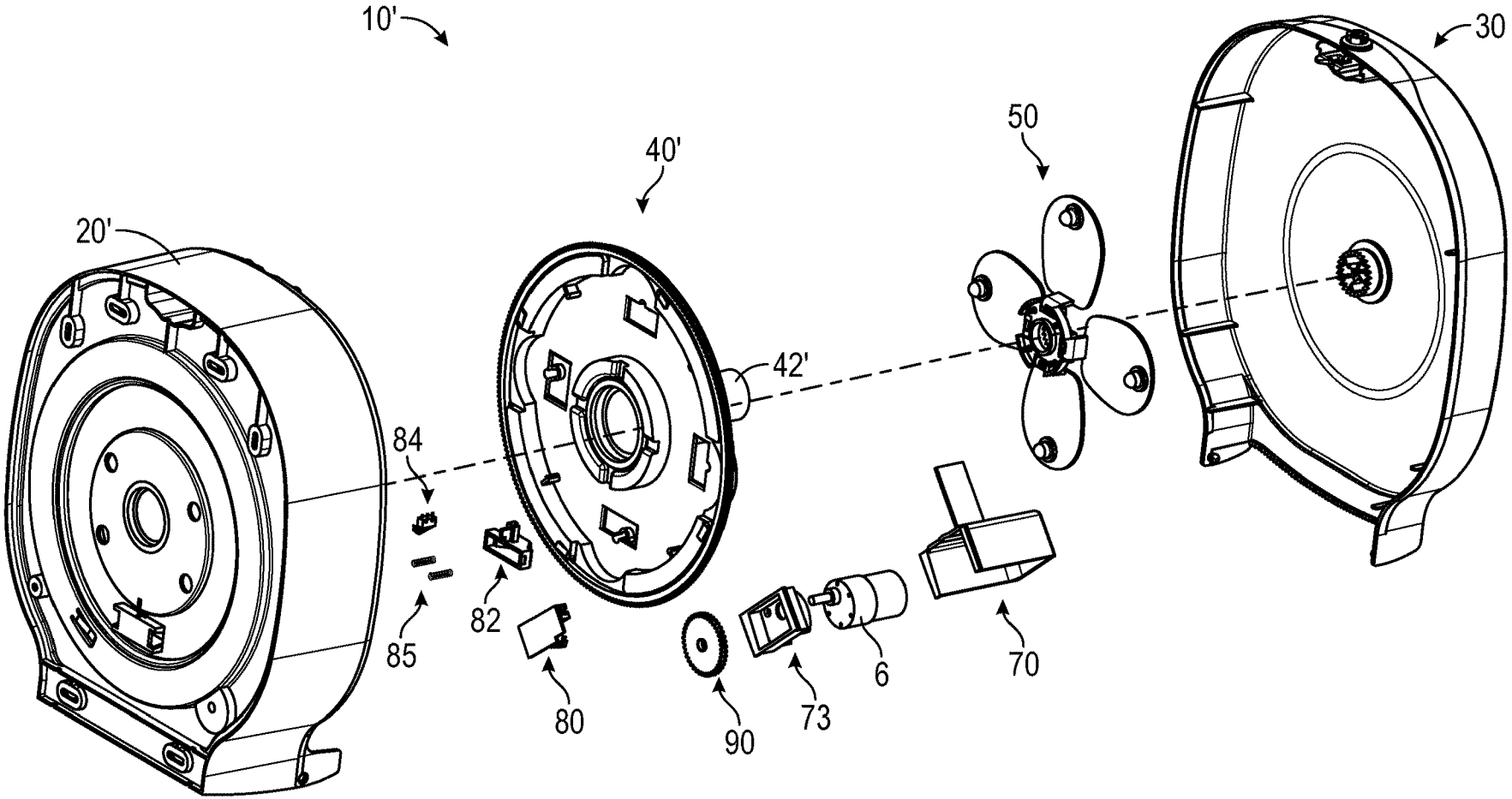
FIG. 12 illustrates an exploded perspective view of another embodiment of a dispenser.

FIG. 12 illustrates another dispenser 10'. As shown in FIG. 12, the dispenser 10' includes another arrangement for the motor 6 and gear 90. More specifically, in contrast to the dispenser 10 where the motor 6 and the gear 90 are positioned proximate a center of the carousel 40, in the dispenser 10', the motor 6 and gear 90 are positioned proximate a perimeter of the carousel 40'. The dispenser 10' can include any of the features of the dispenser 10, with certain modifications described below. Accordingly, the discussion above regarding the dispenser 10 is equally applicable to the dispenser 10'.

The dispenser 10' includes one or more of the cover 30, the support frame 50, the housing 70, the motor 6, the gear 90, the actuator 82, the switch 84, the springs 85, and the printed circuit board 80 that are present in the dispenser 10, and each of these components are described above. In certain implementations, in contrast to the dispenser 10, the dispenser 10' does not include the coupler 88. As described further below, the cabinet 20' includes an engagement portion 24' that can directly connect to the projection 42' of the carousel 40', thus obviating the need for the coupler 88. The projection 42' can be identical to the projection 42 of carousel 40 described above. The dispenser 10' includes a cabinet 20' which can be identical to the cabinet 20 of dispenser 10 except with respect to the features described below. The dispenser 10' includes a carousel 40' which can be identical to the carousel 40 of dispenser 10 except with respect to the features described below.

Figure 13B:
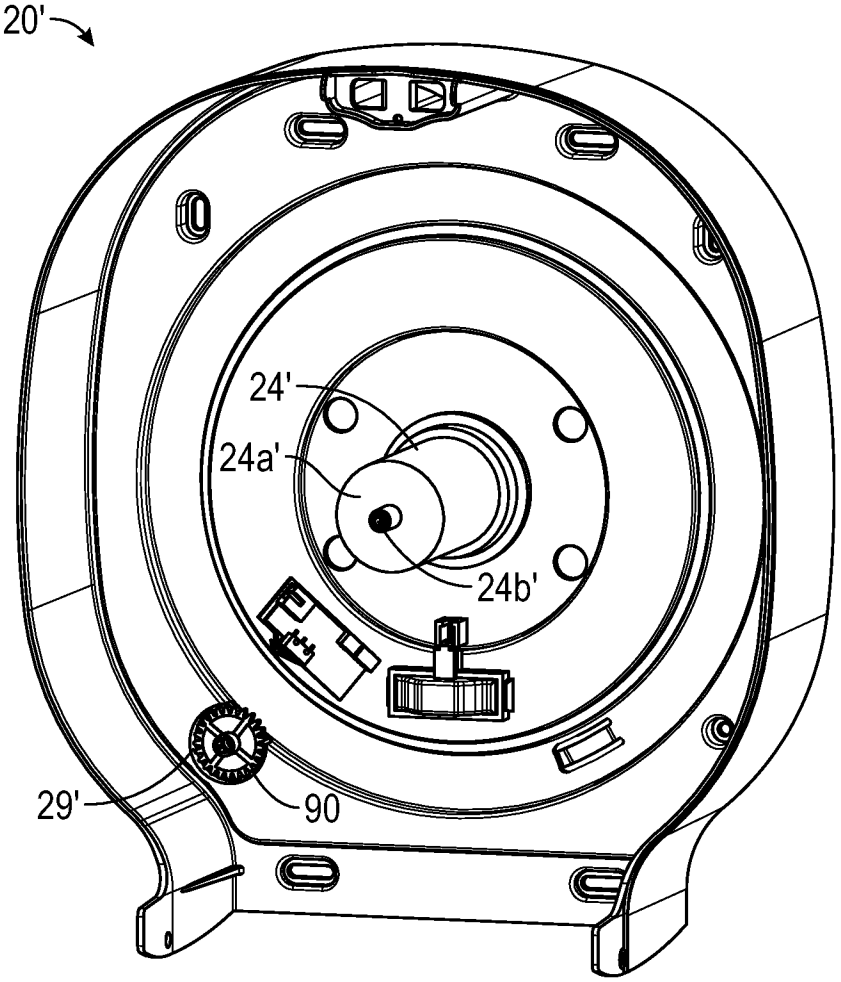
FIG. 13B illustrates a perspective view of the cabinet of FIG. 13A with additional components secured thereto in accordance with aspects of this disclosure.
Figure 13A:
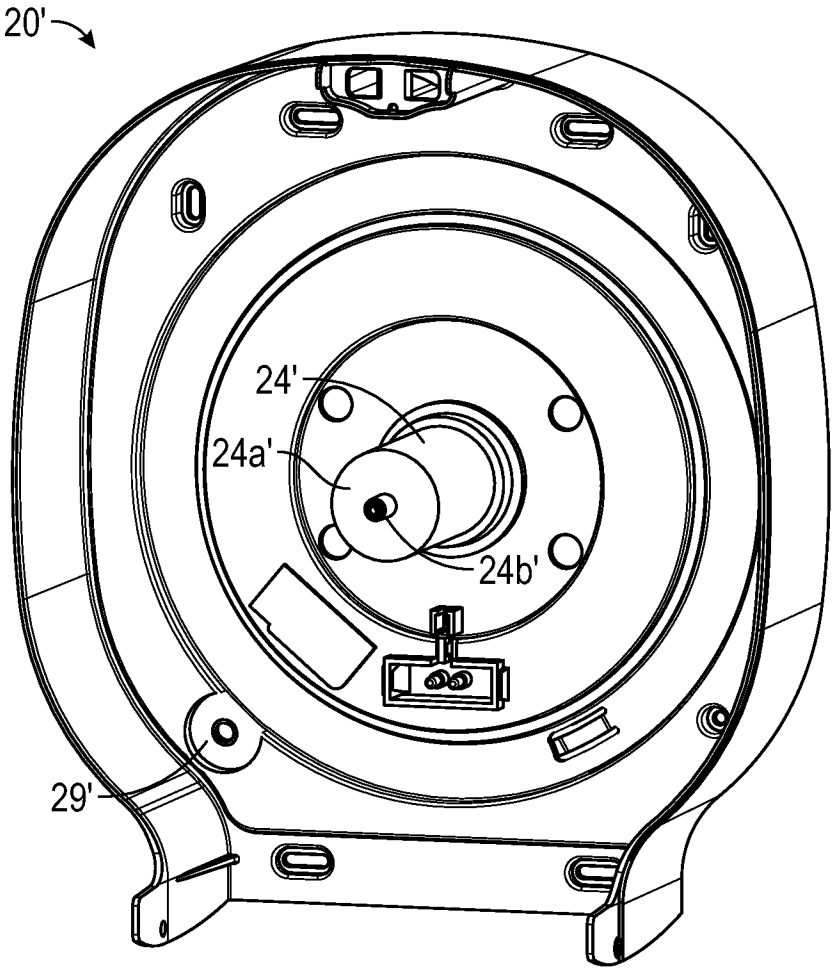
FIG. 13A illustrates a perspective view of a cabinet of the dispenser of FIG. 12.

FIGS. 13A-13B illustrate views of the cabinet 20' that are similar to the views of the cabinet 20 shown in FIGS. 5A-5B. The engagement portion 24' of the cabinet 20' differs from the engagement portion 24 of the cabinet 20' in that the engagement portion 24' can obviate the need for the coupler 88. The engagement portion 24' extends outward from a portion of the cabinet 20' and comprises an end 24*a'* having a stem 24*b'* extending outward from the end 24*a*. The engagement portion 24' can secure within the projection 42' of the carousel 40' similar or identical to how the coupler 88, the end 88*a*, and the stem 88*b* of the dispenser 10 secure within the projection 42 of carousel 40. As shown, the cabinet 20' can include a recessed portion 29' that is sized and/or shaped to receive the gear 90.

Figures 14A, 14B:
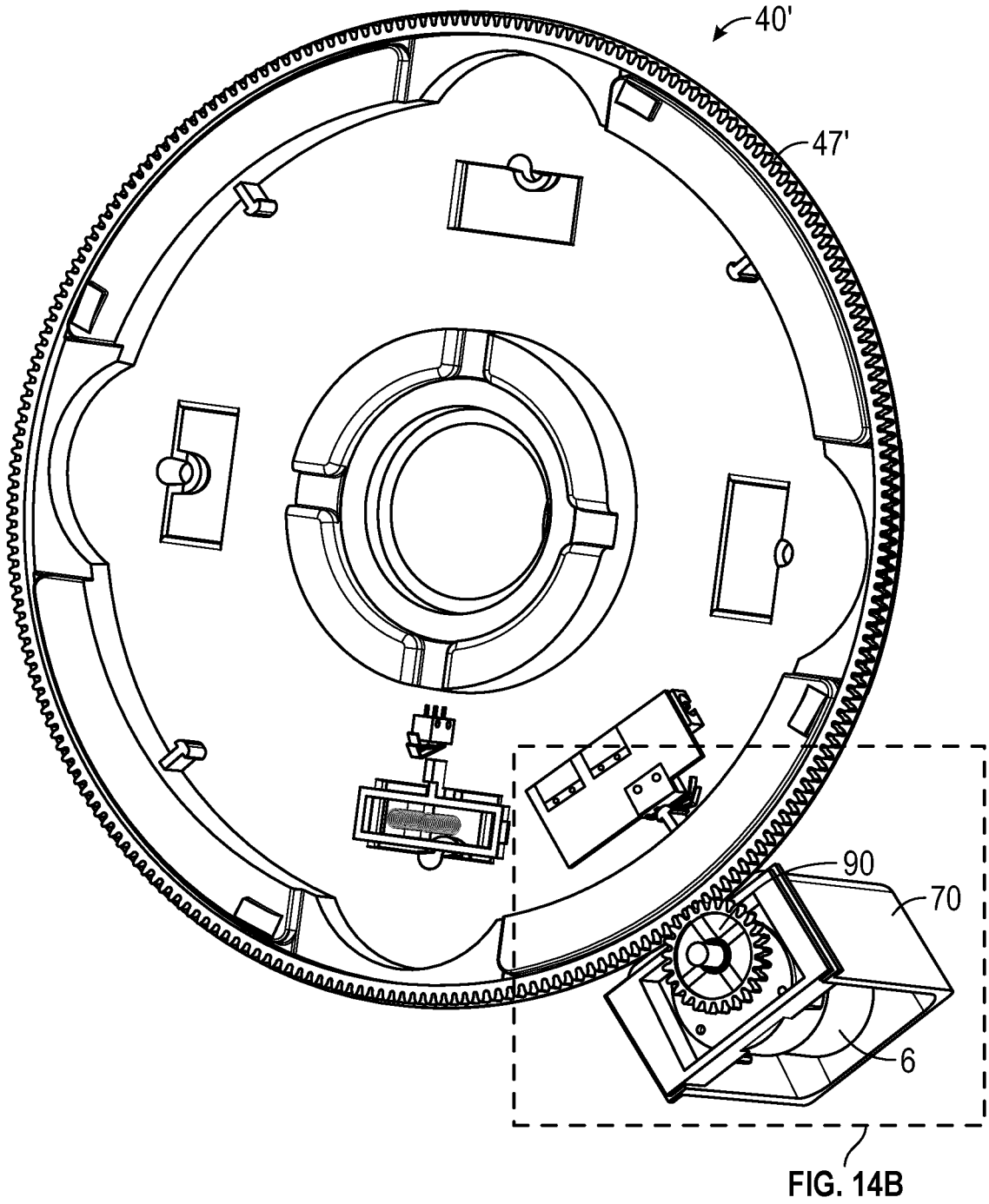
FIG. 14A illustrates a perspective view of a portion of the dispenser of FIG. 12 in accordance with aspects of this disclosure.
FIG. 14B illustrates an enlarged view of a portion of the dispenser shown in FIG. 14A.
Figure 14B:
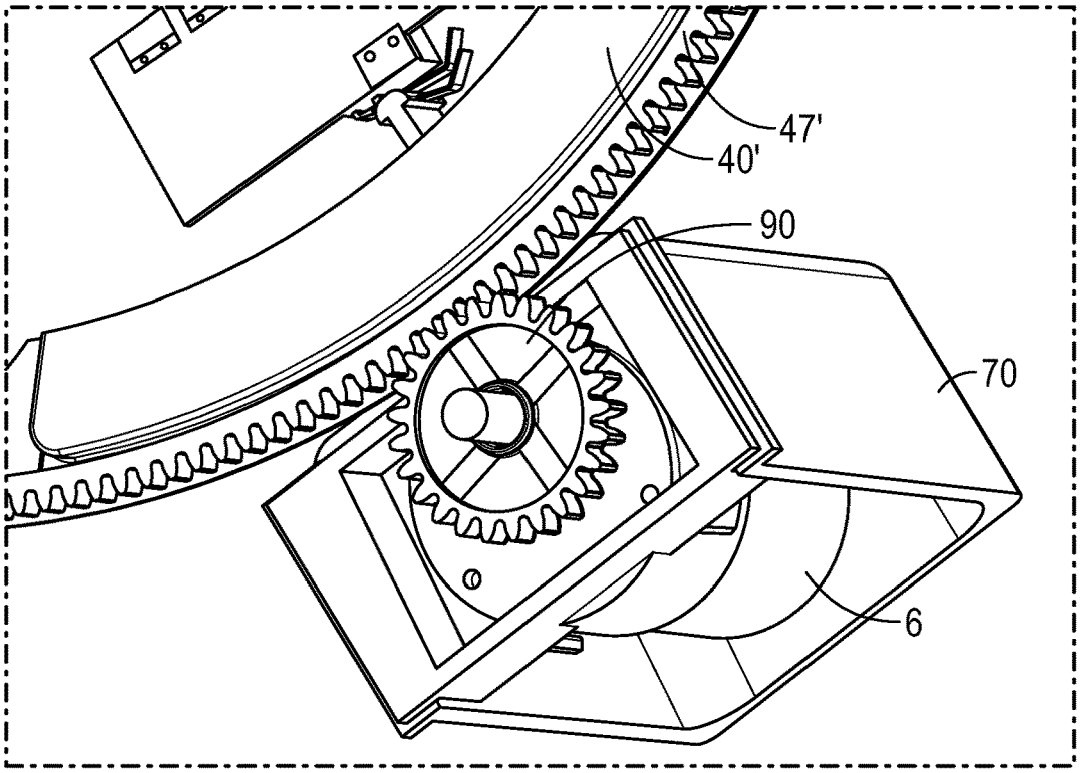
Figure 14C:
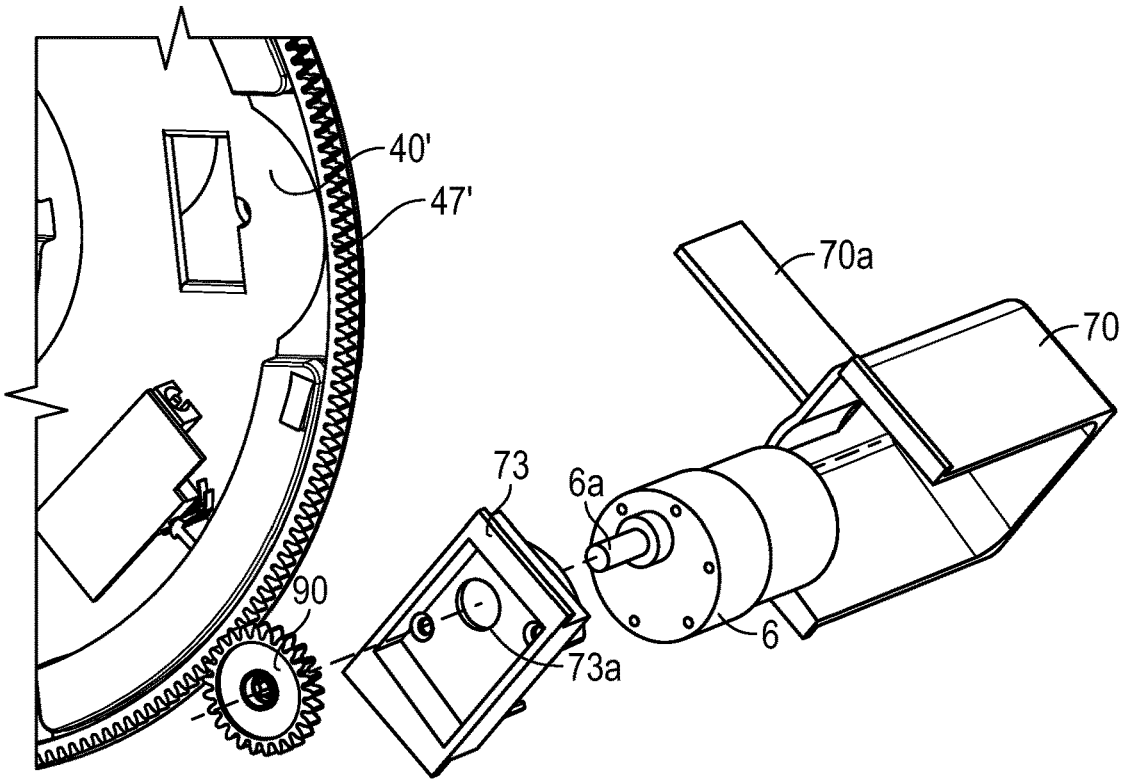
FIG. 14C illustrates an exploded view of the portion shown in FIG. 14B.

FIG. 14A illustrates an enlarged view of a portion of the dispenser 10' including the carousel 40', gear 90, housing 70, and motor 6. FIG. 14B illustrates an enlarged view of a portion of that shown in FIG. 14A. FIG. 14C illustrates an exploded view of that shown in FIG. 14B. The carousel 40' can be identical to the carousel 40 except with respect to the teeth 47'. In contrast to the placement of the teeth 47 proximate a center interior of the carousel 40, the carousel 40' includes teeth 47' positioned along a perimeter of the carousel 40'. As shown, such teeth 47' can engage (e.g., mate with) teeth of the gear 90. As also shown, the motor 6 can be positioned within the housing 70, which is discussed above with reference to dispenser 10. The dispenser 10' can additionally include a housing cap 73 configured to secure to the housing 70 to secure and/or position the motor 6. The housing cap 73 can include an opening 73 (which can be circular) configured to receive a portion 6*a* of the motor that is coupled to the gear 90. The controller 3 can instruct the motor 6 to rotate the gear 90, and in turn, the carousel 40' in an identical manner to that discussed above with reference to dispenser 10.

While dispenser 10 and dispenser 10' include carousels 40, 40' that differ in the respect as discussed above, either of the carousels 40, 40' could include both of teeth 47 and teeth 47 in some variants. Such embodiments can provide flexibility in the arrangement and/or configuration of the dispenser 10 and components thereof (e.g., the placement or location of the motor 6 and/or gear 90).

Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees and the term "generally perpendicular" can refer to something that departs from exactly perpendicular by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Summary

The technology of the present disclosure has been discussed in the context of certain embodiments and examples. The technology extends beyond the specifically disclosed embodiments to other alternative embodiments and/or uses of the embodiments and certain modifications and equivalents thereof. For example, although certain embodiments are disclosed in the context of a tissue dispenser in which the first and second support frames connect to the front and rear of the dispenser, the technology can be applied to other dispenser configurations too, such as configurations in which the first and second support frames connect to left and right sides of the dispenser. Any two or more of the components of the dispenser system can be made from a single monolithic piece or from separate pieces connected together. Various features and aspects of the disclosed embodiments can be combined with or substituted for one another in order to form varying modes of the invention. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying drawings. The figures are drawn to scale, but such scale is not limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of dispensing systems and related methods have been disclosed. Although the dispensing systems have been disclosed in the context of those embodiments and examples, the technology of this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

The following is claimed:

1. A tissue dispenser comprising:

a housing comprising a cabinet, an interior, and an opening;

a roll support assembly positioned within the interior of the housing and configured to support a plurality of rolls of consumable material, the roll support assembly comprising:

a carousel comprising a first plurality of stubs, each of the first plurality of stubs configured to support a first end of a respective one of the plurality of rolls;

a base connected to the carousel; and a plurality of wings pivotally connected to the base, the plurality of wings comprising a second plurality of stubs, each of the second plurality of stubs positioned on a respective one of the plurality of wings and configured to support a second end of a respective one of the plurality of rolls;

a motor configured to rotate the roll support assembly from at least a first rotational position to a second rotational position, wherein, in the first rotational position, a first one of the plurality of rolls is proximate the opening of the housing, and wherein, in the second rotational position, a second one of the plurality of rolls is proximate the opening of the housing;

a roll sensor mechanism configured to detect whether a diameter of the first one of the plurality of rolls is less than a threshold value when the roll support assembly is in the first rotational position; and the tissue dispenser configured such that, in response to the roll sensor mechanism detecting that the diameter of the first one of the plurality of rolls is less than the threshold value, the motor rotates the roll support assembly from the first rotational position to the second rotational position.

2. The tissue dispenser of claim 1, wherein the roll sensor mechanism comprises a proximity sensor and a controller.

3. The tissue dispenser of claim 1, wherein the roll sensor mechanism comprises a switch and an actuator configured to engage the switch, the actuator moveable between a first position and a second position, wherein the roll sensor mechanism is configured to detect that the diameter is less than the threshold value when the actuator moves from the first position to the second position.

4. The tissue dispenser of claim 3, wherein:

when the diameter is greater than or equal to the threshold value, an end of the first one of the plurality of rolls presents a physical interference that inhibits the actuator from moving from the first position to the second position; and when the diameter is less than the threshold value, the physical interference is removed, thereby allowing the actuator to move from the first position to the second position.

5. The tissue dispenser of claim 3, wherein the carousel comprises:

a body, wherein the first plurality of stubs extend outward from the body;

a projection extending outwards from the body and connected to the base of the roll support assembly; and a plurality of openings in the body, each of the plurality of openings configured to receive at least a portion of the actuator and positioned adjacent to a respective one of the first plurality of stubs.

6. The tissue dispenser of claim 5, wherein, when the actuator of the roll sensor mechanism is in the second position, the actuator extends through one of the plurality of openings in the body of the carousel.

7. The tissue dispenser of claim 6, wherein each of the first plurality of stubs comprises a notched portion connected to the body of the carousel and an end portion connected to the notched portion, wherein, when the actuator is in the second position, the actuator is positioned within a space defined by the notch portion and contacts the end portion.

8. The tissue dispenser of claim 5, wherein:

when the roll support assembly is in the first rotational position, the actuator is positioned proximate to a first one of the plurality of openings of the body of the carousel; and when the roll support assembly is in the second rotational position, the actuator is positioned proximate to a second one of the plurality of openings of the body of the carousel.

9. The tissue dispenser of claim 5, further comprising a carousel position switch in communication with a controller, wherein the carousel further comprises a plurality of protrusions connected to the body, a first one of the plurality of protrusions configured to engage the carousel position switch when the roll support assembly is in the first rotational position and a second one of the plurality of protrusions configured to engage the carousel position switch when the roll support assembly is in the second rotational position.

10. The tissue dispenser of claim 1, wherein each of the plurality of wings are configured to pivot relative to the base between a first position and a second position, and wherein the second position provides access to a portion of the interior of the housing, thereby allowing a user to at least partially secure a new roll of consumable product to one of the first plurality of stubs of the carousel.

11. An apparatus for dispensing consumable material, the apparatus comprising:

a housing comprising a cabinet, an interior, and an opening;

a roll support assembly positioned within the interior of the housing and configured to support a plurality of rolls of consumable material;

a motor configured to rotate the roll support assembly from at least a first rotational position to a second rotational position, wherein, in the first rotational position, a first one of the plurality of rolls is proximate the opening of the housing, and wherein, in the second rotational position, a second one of the plurality of rolls is proximate the opening of the housing;

a roll sensor mechanism comprising a switch and an actuator, the roll sensor mechanism configured to detect whether a diameter of the first one of the plurality of rolls is less than a threshold value when the roll support assembly is in the first rotational position responsive to movement of the actuator relative to the switch; and a controller in communication with the roll sensor mechanism and the motor, wherein, in response to the roll sensor mechanism detecting that the diameter of the first one of the plurality of rolls is less than the threshold value, the controller is configured to instruct the motor to rotate the roll support assembly from the first rotational position to the second rotational position.

12. The apparatus of claim 11, wherein:

the actuator is moveable between a first position and a second position and is configured to engage the switch at least when in the first position;

when the diameter is greater than or equal to the threshold value, the first one of the plurality of rolls presents a physical interference that inhibits the actuator from moving from the first position to the second position; and when the diameter is less than the threshold value, the physical interference is removed, thereby allowing the actuator to move from the first position to the second position.

13. The apparatus of claim 12, wherein the switch and the actuator are at least partially secured by the cabinet.

14. The apparatus of claim 12, wherein the roll support assembly comprises:

a first support frame operatively connected to the cabinet, the first support frame comprising a first plurality of stubs, each of the first plurality of stubs configured to support a first end of a respective one of the plurality of rolls; and a second support frame operatively connected to the first support frame, the second support frame comprising a second plurality of stubs, each of the second plurality of stubs configured to support a second end of a respective one of the plurality of rolls.

15. The apparatus of claim 14, wherein the second plurality of stubs are aligned with the first plurality of stubs.

16. The apparatus of claim 14, wherein the first support frame comprises a carousel, the carousel comprising:

a body, wherein the first plurality of stubs extend outward from the body;

a projection extending outwards from the body; and a plurality of openings in the body, each of the plurality of openings configured to receive at least a portion of the actuator and positioned adjacent to a respective one of the first plurality of stubs.

17. The apparatus of claim 16, wherein, when the actuator of the roll sensor mechanism is in the second position, the actuator extends through one of the plurality of openings in the body of the carousel.

18. The apparatus of claim 16, further comprising a gear operatively connected to the motor, wherein the body of the carousel comprises gear threads configured to mate with teeth of the gear, and wherein the motor is configured to rotate the roll support assembly via engagement of the gear and the gear threads.

19. The apparatus of claim 16, wherein the second support frame comprises:

a base connected to the projection of the carousel; and a plurality of wings pivotally connected to the base, each of the plurality of wings comprising one of the second plurality of stubs.

20. The apparatus of claim 16, further comprising a carousel position switch in communication with the controller, wherein the carousel further comprises a plurality of protrusions connected to the body, a first one of the plurality of protrusions configured to engage the carousel position switch when the roll support assembly is in the first rotational position and a second one of the plurality of protrusions configured to engage the carousel position switch when the roll support assembly is in the second rotational position.

* * * * *